US009046853B2

(12) United States Patent
Wada et al.

(10) Patent No.: US 9,046,853 B2
(45) Date of Patent: Jun. 2, 2015

(54) IMAGE FORMING APPARATUS

(71) Applicants: Yuuji Wada, Kanagawa (JP); Atsushi Nagata, Kanagawa (JP)

(72) Inventors: Yuuji Wada, Kanagawa (JP); Atsushi Nagata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/209,330

(22) Filed: Mar. 13, 2014

(65) Prior Publication Data

US 2014/0270819 A1 Sep. 18, 2014

(30) Foreign Application Priority Data

Mar. 14, 2013 (JP) ..... 2013-052496
Mar. 15, 2013 (JP) ..... 2013-052813

(51) Int. Cl.

| | |
|---|---|
| ***G03G 15/08*** | (2006.01) |
| ***G03G 15/00*** | (2006.01) |
| ***G03G 15/01*** | (2006.01) |
| ***G03G 15/16*** | (2006.01) |

(52) U.S. Cl.

CPC ..... *G03G 15/553* (2013.01); *G03G 15/0189* (2013.01); *G03G 15/1605* (2013.01); *G03G 15/1675* (2013.01); *G03G 15/556* (2013.01)

(58) Field of Classification Search

CPC ..... G03G 15/0822; G03G 15/0848; G03G 15/1675

USPC ..... 399/29, 66

See application file for complete search history.

(56) References Cited

U.S. PATENT DOCUMENTS

| | | | | |
|---|---|---|---|---|
| 2008/0088883 | A1 | 4/2008 | Yoshida | |
| 2009/0180791 | A1 | 7/2009 | Matsushita et al. | |
| 2011/0013920 | A1 | 1/2011 | Wada | |
| 2011/0222128 | A1 | 9/2011 | Wada | |
| 2012/0128381 | A1* | 5/2012 | Hosohara et al. | 399/49 |

FOREIGN PATENT DOCUMENTS

| | | |
|---|---|---|
| JP | 5-158357 | 6/1993 |
| JP | 9-134044 | 5/1997 |
| JP | 2000-314999 | 11/2000 |
| JP | 2004-061602 | 2/2004 |
| JP | 2006-145950 | 6/2006 |
| JP | 2007-078942 | 3/2007 |
| JP | 2008-096687 | 4/2008 |
| JP | 2009-168925 | 7/2009 |
| JP | 2012-073391 | 4/2012 |

* cited by examiner

*Primary Examiner* — David Bolduc
*Assistant Examiner* — Barnabas Fekete
(74) *Attorney, Agent, or Firm* — Oblon, McClelland, Maier & Neustadt, L.L.P.

(57) ABSTRACT

An image forming apparatus includes a primary transfer bias adjuster to adjust, in a second mode, a primary transfer bias by a correction amount in accordance with a degree of deterioration of a developing agent detected by a first developing agent condition detector so as to reduce a primary transfer current of the primary transfer bias upon transferring a toner image from a first image bearing member onto an intermediate transfer member, and to adjust, in a first mode, the primary transfer bias by a correction amount less than the correction amount in the second mode or not to adjust the primary transfer bias in accordance with the degree of deterioration of the developing agent detected by the first developing agent condition detector upon primarily transferring the toner image from the first image bearing member onto the intermediate transfer member.

20 Claims, 20 Drawing Sheets

FIG. 6

| TIME GROUP | PRIMARY TRANSFER CURRENT | | | | | SECONDARY TRANSFER CURRENT | |
|---|---|---|---|---|---|---|---|
| | FULL COLOR MODE | | | | SINGLE COLOR BLACK MODE | FULL COLOR MODE | SINGLE COLOR BLACK MODE |
| | Y | M | C | K | K | T2 | T2 |
| INITIAL STATE | 50 | 45 | 42 | 40 | 40 | 50 | 40 |
| ELAPSED TIME 1 | 45 | 40 | 37 | 38 | 35 | 47 | 37 |
| ELAPSED TIME 2 | 40 | 35 | 32 | 36 | 30 | 44 | 34 |

FIG. 7

| TIME GROUP | PRIMARY TRANSFER CURRENT | | | | | SECONDARY TRANSFER CURRENT | |
|---|---|---|---|---|---|---|---|
| | FULL COLOR MODE | | | | SINGLE COLOR BLACK MODE | FULL COLOR MODE | SINGLE COLOR BLACK MODE |
| | Y | M | C | K | K | T2 | T2 |
| INITIAL STATE | 50 | 45 | 42 | 40 | 40 | 50 | 40 |
| ELAPSED TIME 1 | 45 | 40 | 37 | 40 | 35 | 47 | 37 |
| ELAPSED TIME 2 | 40 | 35 | 32 | 40 | 30 | 44 | 34 |

FIG. 9

INITIAL STATE

| IMAGE PATTERN | COLOR | CONVENTIONAL EXAMPLE 1 | CONVENTIONAL EXAMPLE 2 | EMBODIMENT 1 | EMBODIMENT 2 | EMBODIMENT 3 |
|---|---|---|---|---|---|---|
| DENSITY OF SOLID IMAGE | K | ○ | ○ | ○ | ○ | ○ |
| | C | ○ | ○ | ○ | ○ | ○ |
| | C+M | ○ | ○ | ○ | ○ | ○ |
| DENSITY OF SMALL PATCH | K | ○ | ○ | ○ | ○ | ○ |
| | C | ○ | ○ | ○ | ○ | ○ |
| | C+M | ○ | ○ | ○ | ○ | ○ |

FIG. 10

ELAPSED TIME 1

| IMAGE PATTERN | COLOR | CONVENTIONAL EXAMPLE 1 | CONVENTIONAL EXAMPLE 2 | EMBODIMENT 1 | EMBODIMENT 2 | EMBODIMENT 3 |
|---|---|---|---|---|---|---|
| DENSITY OF SOLID IMAGE | K | △ | △ | ○ | ○ | ○ |
| | C | △ | △ | ○ | ○ | ○ |
| | C+M | ○ | ○ | ○ | ○ | ○ |
| DENSITY OF SMALL PATCH | K | ○ | ○ | ○ | ○ | ○ |
| | C | ○ | ○ | ○ | ○ | ○ |
| | C+M | ○ | ○ | ○ | ○ | ○ |

FIG. 11

ELAPSED TIME 2

| IMAGE PATTERN | COLOR | CONVENTIONAL EXAMPLE 1 | CONVENTIONAL EXAMPLE 2 | EMBODIMENT 1 | EMBODIMENT 2 | EMBODIMENT 3 |
|---|---|---|---|---|---|---|
| DENSITY OF SOLID IMAGE | K | POOR | POOR | GOOD | GOOD | GOOD |
| | C | POOR | POOR | GOOD | GOOD | GOOD |
| | C+M | FAIR | FAIR | FAIR-GOOD | GOOD | FAIR |
| DENSITY OF SMALL PATCH | K | GOOD | GOOD | GOOD | GOOD | FAIR |
| | C | GOOD | GOOD | GOOD | GOOD | GOOD |
| | C+M | GOOD | GOOD | GOOD | GOOD | GOOD |

FIG. 26

| | LL | ML | MM | MH | HH |
|---|---|---|---|---|---|
| DETERIORATION 1 | 96% | 94% | 92% | 90% | 88% |
| DETERIORATION 2 | 88% | 86% | 84% | 82% | 80% |
| DETERIORATION 3 | 80% | 78% | 76% | 74% | 72% |

FIG. 27

| ROLLER RESISTANCE | DETECTED VOLTAGE |
|---|---|
| 7.0th POWER | 0.82kV |
| 7.5th POWER | 1.40kV |
| 8.0th POWER | 1.88kV |
| 8.5th POWER | 2.28kV |
| 9.0th POWER | 2.60kV |

FIG. 28

| ROLLER RESISTANCE | OPTIMUM CURRENT VALUE |
|---|---|
| 7.0th POWER | 29 μA |
| 7.5th POWER | 25 μA |
| 8.0th POWER | 21 μA |
| 8.5th POWER | 21 μA |
| 9.0th POWER | 17 μA |

FIG. 29

| DETECTED VOLTAGE | ROLLER RESISTANCE | NO DETERIORATION | DETERIORATION 1 | DETERIORATION 2 | DETERIORATION 3 |
|---|---|---|---|---|---|
| 1.0kV or LESS | 7.0th POWER | 117% | 108% | 98% | 89% |
| 1.0kv-1.6kV | 7.5th POWER | 100% | 92% | 84% | 76% |
| 1.6kV-2.4kV | 8.0th to 8.5 POWER | 83% | 76% | 70% | 63% |
| 2.4kV or MORE | 9.0th POWER | 67% | 62% | 56% | 51% |

IMAGE FORMING APPARATUS

CROSS-REFERENCE TO RELATED APPLICATIONS

This patent application is based on and claims priority pursuant to 35 U.S.C. §119 from Japanese Patent Application Nos. 2013-052496, filed on Mar. 14, 2013, and 2013-052813, filed on Mar. 15, 2013, both in the Japan Patent Office, which are hereby incorporated herein by reference in their entirety.

BACKGROUND

1. Technical Field

Exemplary aspects of the present invention generally relate to an image forming apparatus, such as a copier, a facsimile machine, a printer, or a multi-functional system including a combination thereof, and more particularly to a tandem-type image forming apparatus.

2. Description of the Related Art

Known image forming apparatuses using an intermediate transfer method are generally equipped with a plurality of image bearing members arranged in tandem along a moving direction of an intermediate transfer member. Toner images are formed on the plurality of image bearing members and then transferred primarily onto the intermediate transfer member. Subsequently, the toner images are secondarily transferred onto a recording medium. In such image forming apparatuses using the intermediate transfer method, toner images are formed on at least two image bearing members and the toner images are primarily transferred onto the intermediate transfer member such that they are superimposed one atop the other, forming a composite toner image, which is then transferred onto a recording medium in a multi-color mode (first control mode). Alternatively, a toner image is formed on a single image bearing member, and primarily transferred onto the intermediate transfer member, and then transferred onto a recording medium in a single-color mode (second control mode).

In this type of image forming apparatuses, a developing agent deteriorates with time, causing insufficient charging of overall toner, which results in an image defects, such as roughness in a halftone image. To address this difficulty, in JP-2009-168925-A, a degree of degradation of an imaging device that forms the toner image on the image bearing member disposed at an extreme downstream end in the moving direction of the intermediate transfer member is detected. When the degree of deterioration reaches a certain level, a level of secondary transfer bias is reduced.

According to JP-2009-168925-A, in a case in which the charge amount of toner is generally low, flow of electrical charge due to movement of the toner is small at a secondary transfer portion, hence generating electric discharge at the secondary transfer portion and resulting in a rough image. In such a case, the secondary transfer bias is reduced so that generation of electric discharge at the secondary transfer portion is suppressed and the roughness in a low-density image is thus reduced.

In this type of image forming apparatus, that is, i.e., a tandem-type image forming apparatus, the plurality of image bearing members is disposed along the moving direction of a transfer medium such as a recording medium and the intermediate transfer member, and the toner images formed on the image bearing members are transferred onto the transfer medium. The toner images on the image bearing members are transferred onto the transfer medium by applying a transfer bias from a transfer device. A ratio (transfer rate) of toner constituting the toner image to be transferred onto the transfer medium depends on the charge amount of toner and the level of the transfer bias.

JP-H05-158357-A proposes a monochrome image forming apparatus that directly transfers a toner image from a single image bearing member, i.e., a photosensitive drum onto a recording medium (transfer medium). This image forming apparatus measures a number of printed sheets or a number of printed sheets corresponding to mixing of the developing agent. Based on the measurement, the transfer bias is adjusted to have an optimum transfer current which is inversely proportional to changes in the charge amount of toner with time. In this configuration, even when the charge amount of toner is generally low due to deterioration of the developing agent with time, adjustment of the transfer current according to the deterioration of the developing agent suppresses image defects attributed to the deterioration of the developing agent.

In the image forming apparatus using the intermediate transfer method, when the developing agent deteriorates with time, causing the charge amount of overall toner to drop low, primary transfer at the primary transfer portion may be affected. That is, even before secondary transfer, the toner image may be degraded. It is difficult to prevent such degradation of image quality only by adjusting the secondary transfer bias as described above. In order to suppress degradation of image quality attributed to the deterioration of the developing agent with time, causing the charge amount of overall toner to drop low, it may be necessary to adjust the primary transfer bias to be applied to the primary transfer portion.

FIG. 12 is a graph showing relations between a primary transfer rate and a primary transfer current in an initial state in which the developing agent has not deteriorated yet.

FIG. 13 is a graph showing relations between the primary transfer rate and the primary transfer current when the developing agent deteriorated with time.

FIGS. 12 and 13 show results of measurement on a 5% band image and a 95% band image. As illustrated in FIG. 14, the 5% band image is a band-shaped toner pattern having a width which corresponds to 5% of an entire imaging width, formed substantially in the center in a main scanning direction and extending in a sub-scanning direction (sheet moving direction). As illustrated in FIG. 15, the 95% band image is a band-shaped toner pattern having a width which corresponds to 95% of the entire imaging width, formed at one side in the main scanning direction, and extending in the sub-scanning direction (sheet moving direction).

In the initial state in which the developing agent has not yet deteriorated, the relations between the primary transfer rate and the primary transfer current for the 5% band image and the 95% band image look like the one shown in FIG. 12, in which there is a peak in the primary transfer rate for both images. An optimum level of the primary transfer current for achieving a highest possible primary transfer rate within a range in which substantially the same primary transfer rate is achieved for both the 5% band image and the 95% band image is similar to or the same value such as shown in FIG. 12. Generally, in most cases, the primary transfer current is set to the value shown in FIG. 12.

By contrast, when the developing agent deteriorated with time, the relations between the primary transfer rate and the primary transfer current for the 5% band image and the 95% band image look like the one shown in FIG. 13. In FIG. 13, the highest peak of the primary transfer rate for the 95% band image shifts largely toward a low primary transfer current (absolute value) side as compared with the initial state. In this case, the optimum primary transfer current for achieving the highest possible primary transfer rate within the range in which substantially the same primary transfer rate is achieved for both the 5% band image and the 95% band image is similar to or the same value such as shown in FIG. 13. As shown in FIG. 13, the absolute value of the optimum primary transfer current decreases with time as compared with the initial state.

The reason for the decrease in the optimum primary transfer current (absolute value) with the deteriorated developing agent with time is assumed as follows.

During which an amount of toner moving from the image bearing member to the intermediate transfer belt at the primary transfer portion increases with an increase in the primary transfer bias, flow of electric current caused by the movement of toner increases, hence increasing the primary transfer current. After the amount of movement of toner reaches a state of saturation, the flow of electric current caused by the movement of toner stops increasing. In this case, electrical discharge at the primary transfer portion increases in accordance with an increase in the primary transfer bias. Thus, once the amount of movement of toner reaches the state of saturation, the primary transfer current keeps increasing in accordance with generation of the electrical discharge.

On the other hand, with an increase in the electrical discharge, the primary transfer rate decreases. That is, after the amount of movement of toner reaches the state of saturation, the primary transfer rate decreases as the primary transfer current increases. As a result, as shown in FIGS. 12 and 13, there is a highest peak in the primary transfer rate in the relations between the primary transfer current and the primary transfer rate. When the developing agent deteriorates with time, the charge amount of toner is relatively low overall. In such a case, the flow of electric current caused by the movement of the toner at the primary transfer portion is less than that in the initial state so that the primary transfer current when the amount of move of toner reaches the state of saturation is less than that in the initial state. As a result, when the developing agent deteriorated with time, the optimum primary transfer current (absolute value) to achieve the optimum primary transfer rate is lower than that in the initial state.

However, the present inventors recognized that reducing uniformly the primary transfer current (absolute value) flowing through the primary transfer portion in accordance with the degree of deterioration of the developing agent may rather degrade the image quality. More specifically, as will be described later, although reducing the primary transfer current enhances the primary transfer rate, reducing the primary transfer current reduces the secondary transfer rate. Therefore, reducing the primary transfer current does not necessarily improve the image quality. Rather, it may reduce the image quality. It is also known that a rate of decrease in the secondary transfer rate after correction of the primary transfer current in the single-color mode (second control mode) is greater in the multi-color mode (first control mode). Thus, if the amount of correction of the primary transfer current in the multi-color mode (first control mode) is the same as or similar to that in the single-color mode (second control mode), the image quality is degraded more easily.

In the first control mode, the toner images formed on the plurality of image bearing members are transferred onto the intermediate transfer member such that they are superimposed one atop the other, forming a composite toner image. The composite toner image thus obtained is transferred secondarily from the intermediate transfer member to a recording medium. By contrast, in the second control mode in which only one of the image bearing members (hereinafter referred to as downstream image bearing member) used in the multi-color mode is used, one toner image without other toner images superimposed thereon is transferred secondarily from the intermediate member to the recording medium. As a result, an amount of toner to be transferred secondarily to the recording medium at the secondary transfer portion, in general, is greater in the first control mode than in the second control mode. Therefore, an optimum secondary transfer bias to achieve an optimum secondary transfer rate is greater in the first control mode than in the second control mode. Thus, the secondary transfer bias is greater in the first control mode than in the second control mode.

At this time, if the primary transfer bias is adjusted so that the primary transfer current is reduced in accordance with the degree of deterioration of the developing agent, the primary transfer rate is enhanced. However, since the charge amount of overall toner is relatively low due to deterioration of the developing agent and hence the primary transfer current is relatively small, the charge amount of toner at the secondary transfer portion is even lower than before correction. Degradation of image quality attributed to the decrease in the charge amount of toner at the secondary transfer portion is greater in the first control mode in which the secondary transfer bias is relatively high than in the second control mode in which the secondary transfer bias is relatively low.

FIG. 16 is a graph showing relations between the secondary transfer rate and the secondary transfer current associated with a toner image on the downstream image bearing member.

The relations between the secondary transfer rate and the secondary transfer current may be considered as having substantially the same relations as between the primary transfer current and the primary transfer rate. That is, during which the amount of toner moving from the image bearing member to the intermediate transfer belt at the secondary transfer portion increases with an increase in the secondary transfer bias, flow of electric current caused by the movement of toner increases, hence increasing the secondary transfer current. By contrast, after the amount of move of toner reaches a state of saturation, the flow of electric current caused by the movement of toner stops increasing. Consequently, the electrical discharge at the secondary transfer portion increases in accordance with an increase in the secondary transfer bias. In this case, the primary transfer current increases with an increase in the electrical discharge while the secondary transfer rate decreases with the increase in the electrical discharge. FIG. 16 shows the resulting relations between the secondary transfer current and the secondary transfer rate.

The secondary transfer current in the first control mode is set to achieve a highest possible secondary transfer rate within a range in which the secondary transfer rates for each of the plurality of toner images constituting the composite toner image are approximately the same (that is, none of the secondary transfer rates has a low value relative to all the other ratios). The toner image to be transferred primarily from the image bearing member disposed in the upstream side in the moving direction of the intermediate transfer member among the plurality of toner images constituting the composite toner image is charged up with the primary transfer current when passing through the primary transfer portion in the downstream therefrom. As a result, the charge amount of toner in the secondary transfer portion is higher than that of the toner image to be transferred primarily from the downstream image bearing member.

In a case in which the secondary transfer current for transferring secondarily the plurality of toner images having different charge amounts all at once is determined as described above, for the toner image with a relatively low charge amount (the toner image transferred primarily from the downstream image bearing member), the secondary transfer current is set to a value higher than a value (peak value) achieving the maximum secondary transfer rate. By contrast, in the second control mode using one image bearing member, i.e., the downstream image bearing member, because there is one toner image, the secondary transfer current is set to achieve the optimum secondary transfer rate for the toner image.

In a case in which the primary transfer bias is adjusted to reduce the primary transfer current for the downstream image bearing member in accordance with the rate of deterioration of the developing agent in the first control mode and in the second control mode in which the respective secondary transfer current is determined in a manner described above, the primary transfer current after correction is low for the toner image on the downstream image bearing member, resulting in a lower charge amount of toner in the secondary transfer portion than before correction. At this time, as the charge amount of toner in the secondary transfer portion decreases, the flow of electric current caused by the movement of the toner at the secondary transfer portion is reduced. Thus, the secondary transfer current when the amount of move of toner reaches the state of saturation (i.e., when the secondary transfer rate reaches its peak) is less than that before correction. As a result, the relations between the secondary transfer current and the secondary transfer rate after correction of the primary transfer bias indicated by a broken line in FIG. 16 shift towards the lower secondary transfer current side as compared with the relations before correction indicated by a solid line in FIG. 16.

As shown in FIG. 16, a rate of change in the secondary transfer rate relative to the change in the secondary transfer current tends to increase as the secondary transfer current shifts away from the peak value capable of achieving the maximum secondary transfer rate. The set value for the secondary transfer current in the first control mode before correction is at a higher secondary transfer current side than the peak value capable of achieving the maximum secondary transfer rate as described above. Consequently, when the peak value shifts toward a lower secondary transfer current side due to correction of the primary transfer bias, the set value for the secondary transfer current after correction shifts even further away from the peak value capable of achieving the maximum secondary transfer rate. As a result, the correction of the primary transfer bias causes the secondary transfer rate to drop significantly.

In the tandem-type image forming apparatus in which the toner images formed on the plurality of image bearing members are transferred onto a transfer medium such that they are superimposed one atop the other, preferably, the transfer current is corrected in accordance with parameters in correlation with the degree of deterioration of the developing agent such as the number of printed sheets as proposed in JP-05-158357-A.

The present inventors have recognized, however, that the effect of correction of the transfer current in accordance with the degree of deterioration of the developing agent relative to degradation of image quality differs depending on the toner images. Furthermore, in the single-drum type image forming apparatus in which the plurality of toner images is formed on the single image bearing member and transferred sequentially onto a transfer medium, when the transfer current is corrected in accordance with the degree of deterioration of the developing agent as described above, the effect of correction of the transfer current on degradation of image quality differs depending on the toner images.

The present inventors have also recognized that in the tandem-type image forming apparatus, the effect of correction of the transfer current in accordance with the degree of deterioration of the developing agent relative to the degradation of image quality differs depending on the image bearing members because the volume resistivity of toners in the developing agents used to form the toner images on the image bearing members differs. That is, depending on the volume resistivity of toners, the rate of change in the optimum value of the transfer current in accordance with the deterioration of the developing agent is different.

An apparent electrostatic capacity of toner having a relatively low volume resistivity decreases as the electrical resistivity decreases so that the toner is difficult to keep relatively the charge. When the charging ability of the toner decreases due to deterioration of the developing agent, the decrease in the charge amount of toner having the low volume resistivity is relatively large. As a result, even when the optimum transfer current is set corresponding to the volume resistivity of the respective toner in the initial state, with deterioration of the developing agent after extended use, the rate of change in the optimum transfer current from the initial state is greater in the toner with the low volume resistivity.

Therefore, if the same correction is performed on the transfer current in accordance with the degree of deterioration of the developing agent on the basis of the toner having a high volume resistivity, adequate correction is not performed for the toner with a low volume resistivity and hence degradation of image quality is not suppressed sufficiently. By contrast, if the same correction is performed on the transfer current in accordance with the degree of deterioration of the developing agent on the basis of the toner having a low volume resistivity, overcorrection occurs for the toner with a high volume resistivity and hence the transfer rate is not improved sufficiently, resulting in the degradation of image quality.

SUMMARY

In view of the foregoing, in an aspect of this disclosure, there is provided a novel image forming apparatus including an intermediate transfer member to move in a first direction; a plurality of image bearing members to bear toner images thereon, the plurality of image bearing members disposed along the first direction; a plurality of toner image forming devices to form the toner images on the plurality of image bearing members using different developing agents; a primary transfer device to apply a primary transfer bias to primarily transfer each of the toner images formed on the plurality of image bearing members onto a surface of the intermediate transfer member to form a composite toner image; a secondary transfer device to apply a secondary transfer bias to secondarily transfer the composite toner image formed on the intermediate transfer member to a recording medium; a controller to selectively control image forming operation between a first mode and a second mode such that in the first mode the composite toner image is formed using at least two of the plurality of image bearing members including a first image bearing member and a second image bearing member and after the composite toner image is formed on the intermediate transfer member the secondary transfer bias is applied to secondarily transfer the composite toner image from the intermediate transfer member to the recording medium, and in the second mode the toner image is formed on the first image bearing member used in the first mode which is disposed downstream from the second image bearing member in the first direction and after the toner image is primarily transferred from the first image bearing member onto the intermediate transfer member the secondary transfer bias less than that in the first mode is applied to transfer the toner image from the intermediate transfer member to the recording medium; a first developing agent condition detector to detect a degree of deterioration of a developing agent used to form the toner image on the first image bearing member; and a primary transfer bias adjuster to adjust, in the second mode, the primary transfer bias by a correction amount in accordance with the degree of deterioration of the developing agent detected by the first developing agent condition detector so as to reduce a primary transfer current of the primary transfer bias upon transferring the toner image from the first image bearing member onto the intermediate transfer member, and to adjust, in the first mode, the primary transfer bias by a correction amount less than the correction amount in the second mode or not to adjust the primary transfer bias in accordance with the degree of deterioration of the developing agent detected by the first developing agent condition detector upon primarily transferring the toner image from the first image bearing member onto the intermediate transfer member.

According to another aspect, an image forming apparatus includes an image bearing member to rotate; an intermediate transfer member to move in a first direction; a plurality of toner image forming devices to form sequentially and overlappingly a plurality of toner images using different developing agents on a surface of the image bearing member to form a composite toner image; a primary transfer device to apply a primary transfer bias to primarily transfer the composite toner image formed on the image bearing member onto a surface of the intermediate transfer member; a secondary transfer device to apply a secondary transfer bias to secondarily transfer the composite toner image having been primarily transferred on the intermediate transfer member onto a recording medium; a controller to selectively control image forming operation between a first mode and a second mode such that in the first mode the composite toner image is formed using at least two of the plurality of toner image forming devices including a first toner image forming device and a second toner image forming device and after the composite toner image is primarily transferred onto the intermediate transfer member the secondary transfer bias is applied to secondarily transfer the composite toner image from the intermediate transfer member onto the recording medium, and in the second mode the first toner image forming device used in the first mode forms the toner image which is transferred after the toner image formed by the toner image forming device other than the first toner image forming device is transferred and after the toner image formed by the first toner image forming device is primarily transferred onto the intermediate transfer member the secondary transfer bias less than that in the first mode is applied to transfer the toner image from the intermediate transfer member onto the recording medium; a developing agent condition detector to detect a degree of deterioration of a developing agent used to form the toner image on the first toner image forming device; and a primary transfer bias adjuster to adjust the primary transfer bias by a correction amount in accordance with the degree of deterioration of the developing agent detected by the developing agent condition detector so as to reduce a primary transfer current of the primary transfer bias upon transferring the toner image formed by the first toner image forming device in the second mode, and to adjust the primary transfer bias by the correction amount less than the correction amount in the second mode or not to adjust the primary transfer bias in accordance with the degree of deterioration of the developing agent detected by the developing agent condition detector upon primarily transferring the toner image formed by the first toner image forming member in the first mode.

According to still another aspect, an image forming apparatus includes a plurality of image bearing members to rotate in a first direction; a plurality of toner image forming devices to form a toner image on a surface of each of the plurality of image bearing members with developing agents including toners having different volume resistivities; a plurality of transfer devices to apply a transfer bias to transfer the toner images formed on the plurality of image bearing members onto a transfer medium to form a composite toner image; a developing agent condition detector to detect a degree of deterioration of the developing agents; and a transfer current adjuster to adjust a transfer current of the transfer bias by a correction amount in accordance with the degree of deterioration of the developing agent detected by the developing agent condition detector upon transferring the toner images formed on at least two image bearing members, the toner images being formed with the developing agents including the toners having different volume resistivities. The correction amount is different between the at least two image bearing members.

According to still another aspect, the image forming apparatus includes an image bearing member to rotate in a first direction; a plurality of toner image forming devices to form toner images on a surface of the image bearing member using different developing agents including toners having different volume resistivities; a transfer device to apply a transfer bias to transfer sequentially the toner images formed on the plurality of image bearing members onto a transfer medium to form a composite toner image; a developing agent condition detector to detect a degree of deterioration of the developing agents; and a transfer current adjuster to adjust a transfer current of the transfer bias by a correction amount in accordance with the degree of deterioration of the developing agents detected by the developing agent condition detector upon transferring at least two toner images formed with the developing agents including the toners having different volume resistivities. The correction amount is different between the at least two toner images.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 6 is a table showing an example of set values of the primary transfer current for each color in accordance with the degree of deterioration of the developing agent and set values of the secondary transfer current;

FIG. 7 is a table showing another example of set values of the primary transfer current for each color in accordance with the degree of deterioration of the developing agent and set values of the secondary transfer current;

FIG. 9 is a table showing results of evaluation of image density when the degree of deterioration of the developing agent is in an initial state;

FIG. 10 is a table showing results of evaluation of image density when the degree of deterioration (time group) of the developing agent is in "ELAPSED TIME 1";

FIG. 11 is a table showing results of evaluation of image density when the degree of deterioration (time group) of the developing agent is in "ELAPSED TIME 2";

FIG. 26 is a table showing an example of environmental coefficients for each environment group corresponding to the degree of deterioration of the developing agent according to a variation 5;

FIG. 27 is a table showing an example of relations between an applied voltage (detection voltage) of the primary transfer roller and an electrical resistivity of the primary transfer roller;

FIG. 28 is a table showing an example of relations between the electrical resistivity of the primary transfer roller and a primary transfer current (an optimum current) capable of achieving a maximum primary transfer rate;

FIG. 29 is a table showing an example of relations between a detected primary transfer voltage and the elapsed time correction coefficient after being changed in accordance with the detected primary transfer voltage.

DETAILED DESCRIPTION

Figure 1:
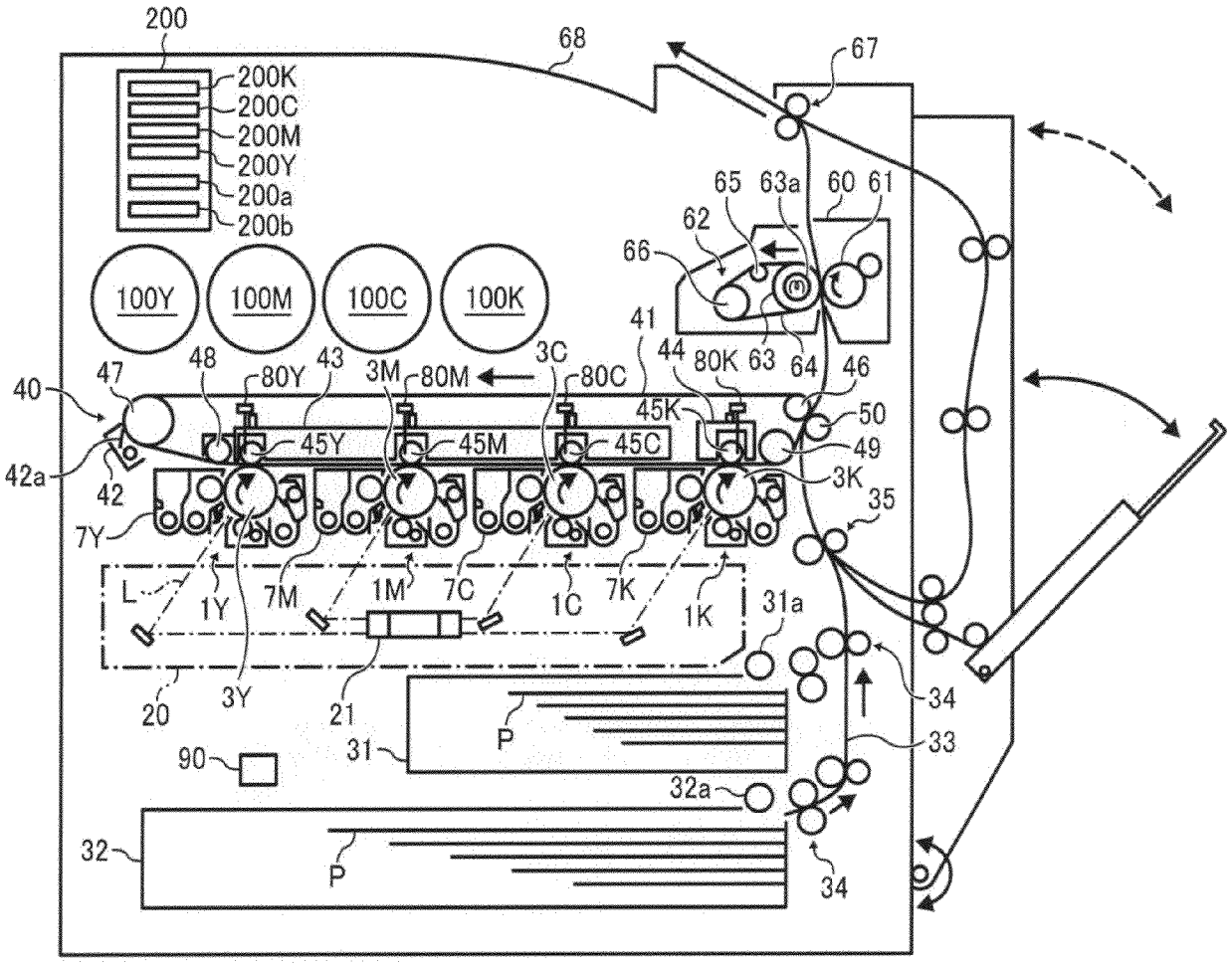
FIG. 1 is a schematic diagram illustrating a printer as an example of an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

FIG. 1 is a schematic diagram illustrating a printer as an example of an image forming apparatus according to an illustrative embodiment of the present disclosure.

Figure 2:
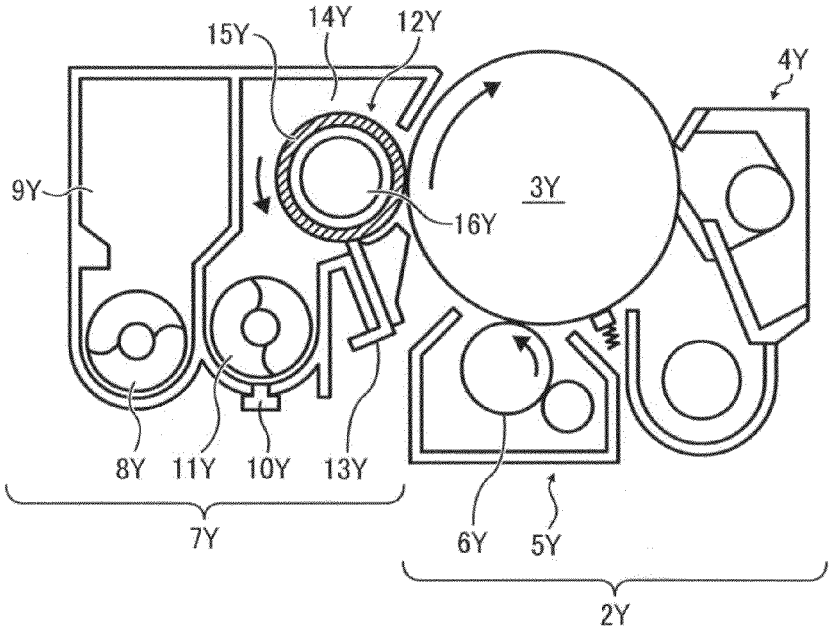
FIG. 2 is a schematic diagram illustrating an image forming unit for the color yellow employed in the image forming apparatus of FIG. 1.

FIG. 2 is a schematic diagram illustrating an image forming unit for the color yellow employed in the image forming apparatus of FIG. 1.

As illustrated in FIG. 1, the image forming apparatus includes four image forming units 1Y, 1C, 1M, and 1K that form toner images of yellow, cyan, magenta, and black, respectively. It is to be noted that the suffixes Y, C, M, and K denote colors yellow, cyan, magenta, and black, respectively. To simplify the description, these suffixes are omitted herein, unless otherwise specified. The image forming units 1Y, 1C, 1M, and 1K all have the same configuration as all the others, differing only in the color of image formation substance, i.e., developing agent employed. Thus, a description is provided of the image forming unit 1Y for forming a toner image of yellow as a representative example of the image forming units.

As illustrated in FIG. 2, the image forming unit 1Y for forming a toner image of the color yellow includes a photosensitive drum unit 2Y including a drum-shaped photosensitive drum 3Y (hereinafter referred to as photosensitive drum) serving as a latent image bearing member and a development device 7Y that develops a latent image formed on the photosensitive drum 3Y. The photosensitive drum unit 2Y and the development device 7Y constitute a single integrated unit as the image forming unit 1Y detachably attachable relative to a main body of the image forming apparatus. When the image forming unit 1Y is detached from the main body, the development device 7Y is detachable from the photosensitive drum unit 2Y.

An optical writing unit 20 as a latent image writing device for writing a latent image on the photosensitive drums 3Y, 3C, 3M, and 3K is disposed substantially below the image forming units 1Y, 1C, 1M, and 1K. After the photosensitive drums 3Y, 3C, 3M, and 3K are uniformly charged, the optical writing unit 20 illuminates the photosensitive drums 3Y, 3C, 3M, and 3K of the image forming units 1Y, 1C, 1M, and 1K with laser light L based on image information. Accordingly, electrostatic latent images for the colors yellow, cyan, magenta, and black are formed on the photosensitive drums 3Y, 3C, 3M, and 3K, respectively. The optical writing unit 20 includes a polygon mirror 21, a plurality of optical lenses, and mirrors. The laser light L projected from a light source is deflected by the polygon mirror driven to rotate by a polygon motor. The deflected light, then, strikes the optical lenses and mirrors, thereby scanning the photosensitive drums 3Y, 3C, 3M, and 3K. Alternatively, optical scanning may be performed by using an LED array.

As illustrated in FIG. 1, a first sheet cassette 31 and a second sheet cassette 32 storing a stack of recording media P are vertically disposed below the optical writing unit 20. The first sheet cassette 31 includes a first sheet feed roller 31*a*. The second sheet cassette 32 includes a second sheet feed roller 32*a*. In the first and second sheet cassettes 31 and 32, a stack of recording media P is stored, and the sheet feed rollers 31*a* and 32*a* contact the top sheet of the stack of the recording media P. As the first sheet feed roller 31*a* is rotated by a driving device in a counterclockwise direction, the top sheet of the recording media P in the first sheet feed cassette 31 is fed to a sheet passage 33 extending vertically at the right side of the first and second sheet cassettes 31 and 32. As the second sheet feed roller 32*a* is rotated by a driving device in a counterclockwise direction, the top sheet of the recording media P in the second sheet feed cassette 32 is fed to the sheet passage 33. A plurality of conveyor roller pairs 34 is disposed in the sheet passage 33, and the recording medium P fed to the sheet passage is interposed between the conveyor roller pairs 34 and delivered upward along the sheet passage 33.

Substantially at the end of the sheet passage 33, a pair of registration rollers 35 is disposed. The pair of registration rollers 35 temporarily stops rotating, immediately after the recording medium P delivered from the conveyor pairs 34 is interposed therebetween. The pair of registration rollers 35 starts to rotate again to feed the recording medium P to a later-described secondary transfer nip in appropriate timing.

Still referring to FIG. 1, a description is provided of a transfer unit 40. The transfer unit 40 is disposed above the image forming units 1Y, 1C, 1M, and 1K. The transfer unit 40 includes an intermediate transfer belt 41 serving as an intermediate transfer member formed into an endless loop and rotated in the counterclockwise direction. The transfer unit 40 includes the intermediate transfer belt 41, a belt cleaning device 42, a first bracket 43, a second bracket 44, four primary transfer rollers 45Y, 45C, 45M, and 45K, a secondary transfer auxiliary roller 46, a drive roller 47, an auxiliary roller 48, a tension roller 49, and so forth. The intermediate transfer belt 41 is entrained around these rollers and rotated endlessly in the counterclockwise direction by the drive roller 47.

The primary transfer rollers 45Y, 45C, 45M, and 45K constitute primary transfer devices. The intermediate transfer belt 41 is interposed between the primary transfer rollers 45Y, 45C, 45M, and 45K, and the photosensitive drums 3Y, 3C, 3M, and 3K, thereby forming primary transfer nips between the intermediate transfer belt 41 and the primary transfer rollers 45Y, 45C, 45M, and 45K. A transfer bias having a polarity (for example, a positive polarity) opposite that of toner is applied to a back surface of the intermediate transfer belt 41 (inner circumferential surface of the looped belt). A power source connected to four primary transfer rollers 45Y, 45C, 45M, and 45K is under constant current control or constant voltage control. As the intermediate transfer belt 41 passes through the primary transfer nips of yellow, cyan, magenta, and black, the toner images of yellow, cyan, magenta, and black on the photosensitive drums 3Y, 3C, 3M, and 3K, respectively, are transferred onto the intermediate transfer belt 41 such that they are superimposed one atop the other, thereby forming a composite toner image on the intermediate transfer belt 41 in the primary transfer process.

As illustrated in FIG. 1, the secondary transfer auxiliary roller 46 serving as a secondary transfer device is disposed inside the loop formed by the intermediate transfer belt 41, opposite a secondary transfer roller 50 which is disposed outside the loop. The intermediate transfer belt 41 is interposed between the secondary transfer auxiliary roller 46 and the secondary transfer roller 50, thereby forming a secondary transfer nip. The pair of registration rollers 35 feeds the recording medium P to the secondary transfer nip in appropriate timing such that the recording medium P is aligned with the composite toner image formed on the intermediate transfer belt 41 in the secondary transfer nip. The composite toner image is transferred secondarily onto the recording medium P due to a secondary transfer electric field generated between the secondary transfer auxiliary roller 46 and the secondary transfer roller 50 and a nip pressure applied to the secondary transfer nip. Accordingly, the full-color toner image is formed on the recording medium P.

After the intermediate transfer belt 41 passes through the secondary transfer nip, residual toner not having been transferred onto the recording medium P remains on the intermediate transfer belt 41. The residual toner is removed by the belt cleaning device 42. The belt cleaning device 42 includes a cleaning blade 42*a* which contacts the surface of the intermediate transfer belt 41 to remove the residual toner therefrom.

Substantially above the secondary transfer nip in FIG. 1, a fixing device 60 for fixing the toner image on the recording medium P is disposed. The fixing device 60 includes a heating-pressure roller 61 and a fixing belt assembly 62. The heating-pressure roller 61 includes a built-in heat source such as a halogen lamp. The fixing belt assembly 62 includes a fixing belt 64 serving as a fixing device, a heating roller 63 including a heat source 63*a* such as a halogen lamp inside thereof, a tension roller 65, and a drive roller 66. The fixing belt 64 is entrained around the heating roller 63, the tension roller 65, and the drive roller 66, and is moved in the counterclockwise direction. While moving endlessly, the fixing belt 64 is heated by the heating roller 63 from the back. The heating-pressure roller 61 rotating in the clockwise direction contacts the outer circumferential surface of the fixing belt 64 wound around the heating roller 63, thereby forming a fixing nip at which the heating-pressure roller 61 contacts the fixing belt 64.

A temperature detector is disposed outside the loop formed by the fixing belt 64 with a certain gap therebetween. The temperature detector detects a surface temperature of the fixing belt 64 immediately before the fixing belt 64 enters the fixing nip. Detection results are sent to a power source circuit. Based on the detection results provided by the temperature detector, the power source circuit controls electrical continuity between the power source and the heat source 63*a* of the heating roller 63, and between the power source and the heat source 61*a* of the heating-pressure roller 61. Accordingly, the surface temperature of the fixing belt 64 is maintained approximately at 140° C., for example.

After passing through the secondary transfer nip and separating from the intermediate transfer belt 41, the recording medium P is sent to the fixing device 60. In the fixing device 60, the composite toner image is fixed onto the recording medium P as the recording medium P is heated and pressed by the fixing belt 64 and the heating-pressure roller 61 while passing through the fixing nip upward.

The recording medium P after fixing is discharged outside the image forming apparatus through a pair of sheet output rollers 67. A sheet stack portion 68 is formed on the upper surface of a main body of the image forming apparatus. The recording medium P discharged outside the image forming apparatus is stacked onto the sheet stack portion 68.

According to the present illustrative embodiment, an image is formed with at least one arbitrarily chosen color. A description is now provided of an example of formation of an image in a black, single color mode (second control mode) and a full-color mode (first control mode). In the black single color mode, only the toner image formed on the photosensitive drum 3K of the color black disposed at the extreme downstream end in the moving direction of the intermediate transfer belt 41 is transferred primarily onto the intermediate transfer belt 41, and then transferred secondarily onto a recording medium P, thereby forming a single color image (monochrome image) of the color black. In the full-color mode, the toner images formed on all the photosensitive drums 3Y, 3C, 3M, and 3K are transferred primarily onto the intermediate transfer belt 41 such that they are superimposed one atop the other, forming a composite toner image. Subsequently, the composite toner image is transferred secondarily onto a recording medium P, thereby forming a four-color (full-color image).

Four toner cartridges 100Y, 100C, 100M, and 100K storing toners of yellow, cyan, magenta, and black, respectively, are disposed above the transfer unit 40. The toner in the toner cartridges 100Y, 100C, 100M, and 100K is supplied to development devices 7Y, 7C, 7M, and 7K of the image forming units 1Y, 1C, 1M, and 1K, respectively. The toner cartridges 100Y, 100C, 100M, and 100K are detachably attachable relative to the main body of the image forming apparatus, independent of the image forming units 1Y, 1C, 1M, and 1K.

As illustrated in FIG. 2, the photosensitive drum unit 2Y includes the photosensitive drum 3Y, a drum cleaning device 4Y, a charge remover, a charging device 5Y for charging the surface of the photosensitive drum 3Y, and so forth. The charging device 5Y charges uniformly the surface of the photosensitive drum 3Y rotated by a driving device in the clockwise direction indicated by an arrow in FIG. 2. In the configuration shown in FIG. 2, the charging device 5Y includes a charging roller 6Y to which a charging bias is applied by a power source. The charging roller 6Y is rotated in the counterclockwise direction and contacts or approaches the photosensitive drum 3Y to charge uniformly the surface of the photosensitive drum 3Y.

Alternatively, a charging brush may be employed instead of the charging roller 6Y and may directly contact the photosensitive drum 3Y, or a scorotron charger or the like may be employed to charge uniformly the photosensitive drum 3Y. The uniformly charged surface of the photosensitive drum 3Y is scanned by the laser light L projected from the optical writing unit 20, thereby forming an electrostatic latent image for the color yellow on the surface of the photosensitive drum 3Y.

The developing unit 7Y includes a first chamber 9Y and a second chamber 14Y. The first chamber 9Y includes a first conveyor screw 8Y. The second chamber 14Y includes a toner density detector 10Y comprised of a magnetic permeability sensor or the like, a second conveyor screw 11Y, a development roller 12Y as a developing agent bearing member, a doctor blade 13Y as a developing agent regulator, and so forth. The first chamber 9Y and the second chamber 14Y store a yellow developing agent consisting of negatively chargeable yellow toner particles and magnetic carriers. The first conveyor screw 8Y is driven to rotate by a drive source and delivers the yellow developing agent in the first chamber 9Y from the proximal side to the distal side in a direction perpendicular to the drawing surface. The yellow developing agent is delivered to the second chamber 14Y through a communication hole formed in a wall separating the first chamber 9Y and the second chamber 14Y.

The second conveyor screw 11Y in the second chamber 14Y is driven to rotate and delivers the yellow developing agent from the proximal side to the distal side. During the delivery of the yellow developing agent, the toner density detector 10Y fixed to the bottom of the first chamber 9Y detects the density of toner. Substantially above the second conveyor screw 11Y, the development roller 12Y is disposed parallel to the second conveyor screw 11Y. The development roller 12Y comprises a development sleeve 15Y made of a non-magnetic pipe which is rotated in the counterclockwise direction, and a magnetic roller 16Y disposed inside the development sleeve 15Y. A portion of the developing agent delivered by the second conveyor screw 11Y is carried onto the surface of the development sleeve 15Y by the magnetic force of the magnetic roller 16Y.

After the thickness of the developing agent layer on the development sleeve 15Y is regulated by the doctor blade 13Y which is spaced apart a certain distance from the development sleeve 15Y, the developing agent is delivered to a developing area facing the photosensitive drum 3Y and the yellow toner is adhered to the electrostatic latent image on the photosensitive drum 3Y, thereby forming a yellow toner image on the photosensitive drum 3Y. The yellow developing agent consumed in development is returned onto the second conveyor screw 11Y as the development sleeve 15Y rotates. When the yellow developing agent is delivered to the proximal end in FIG. 2, the yellow developing agent is returned to the first chamber 9Y through the communication opening.

The detection result of the magnetic permeability of the yellow developing agent detected by the toner detector 10Y is provided as a voltage signal to a controller 200. In order to show a correlation between the toner density of the yellow developing agent and the magnetic permeability of the yellow developing agent, the toner density detector 10Y outputs a voltage corresponding to the yellow toner density.

The controller 200 includes a storage device such as Random Access Memory (RAM), developing agent condition detectors 200K, 200C, 200M, and 200Y for detecting a degree of deterioration of each of the developing agents for the colors black, cyan, magenta, and yellow, respectively, a primary transfer bias adjustor 200*a* for adjusting a primary transfer bias, and a secondary transfer bias adjustor 200*b* for adjusting a secondary transfer adjustor. A target output voltage Vtref output from the toner density detector 10Y and other target output voltages Vtref output from each of the toner density detectors for the colors cyan, magenta, and black are stored in the storage device of the controller 200.

As for the development device 7Y, the output voltage provided by the toner density detector 10Y is compared with the target output voltage Vtref for the color yellow, and a later-described toner supply device for the yellow toner is driven in accordance with the result of comparison. Accordingly, an appropriate amount of yellow toner is supplied to the developing agent in the first chamber 9Y from which the yellow toner is consumed and the toner density of which has dropped during development. The yellow toner density in the second chamber 14Y is maintained within a predetermined range. Similarly, the same toner supply control is carried out for the developing agents of different colors, i.e., developing agents in the image forming units 1C, 1M, and 1K.

The toner image of yellow formed on the photosensitive drum 3Y is transferred primarily onto the intermediate transfer belt 41. The drum cleaning device 4Y removes residual toner remaining on the surface of the photosensitive drum 3Y after the primary transfer process. The charge remover removes residual charge remaining on the photosensitive drum 3Y after the surface thereof is cleaned by the drum cleaning device 4Y so that the surface of the photosensitive drum 3Y is initialized in preparation for the subsequent imaging cycle. Similarly, in the image forming units 1C, 1M, and 1K, a cyan toner image, a magenta toner image, and a black toner image are formed on the photosensitive drums 3C, 3M, and 3K, respectively, and transferred primarily onto the intermediate transfer belt 41.

The primary transfer rollers 45Y, 45C, 45Y, and 45K are made of a metal core and a rubber material having a medium electrical resistivity wound around the metal core. More specifically, the rubber material is foam rubber having a volume resistivity preferably in a range of from $10^6$ Ω·cm to $10^{10}$ Ω·cm, more preferably, in a range of from $10^7$ Ω·cm to $10^9$ Ω·cm. The rubber material is not limited to a foam rubber. Alternatively, it may be solid rubber having a medium electrical resistivity.

The secondary transfer auxiliary roller 46 is made of a metal core and a rubber material having a medium electrical resistivity wound around the metal core. More specifically, the rubber material is solid rubber having a medium electrical resistivity and a volume resistivity preferably in a range of from $10^6$ Ω·cm to $10^{10}$ Ω·cm, more preferably, in a range of from $10^7$ Ω·cm to $10^9$ Ω·cm.

The secondary transfer roller 50 may be formed of foam rubber having a medium electrical resistivity. The volume resistivity thereof is preferably in a range of from $10^6$ Ω·cm to $10^{10}$ Ω·cm, and more preferably, in a range of from $10^7$ Ω·cm to $10^9$ Ω·cm.

The intermediate transfer belt 41 is a three-layer belt including a base layer, an elastic layer, and a surface layer. The base layer has a thickness in a range of from 50 μm to 100 μm and is formed of resin having a medium electrical resistivity such as polyimide (PI), polyamide-imide (PAD, polycarbonate (PC), ethylene tetrafluoroethylene (ETFE), polyvinylidene fluoride (PVDF), polyphenylene sulfide (PPS), and the like, the resistivity of which is adjusted by dispersing carbon or ion conductor.

The elastic layer is disposed on the base layer and has a thickness in a range of from 100 μm to 500 μm. The elastic layer is formed of a rubber material such as urethane, nitrile butadiene (NBR), chloroprene (CR), and the like, the resistivity of which is adjusted similarly by dispersing carbon or ion conductor. The surface layer is formed of fluoro-rubber or resin (or a hybrid material consisting of these materials), having a thickness in a range of from 1 μm to 10 μm, and is disposed on the elastic layer.

More specifically, the volume resistivity of the intermediate transfer belt 41 is preferably in a range of from $10^6$ Ω·cm to $10^{10}$ Ω·cm, more preferably, in a range of from $10^8$ Ω·cm to $10^{10}$ Ω·cm. The surface resistivity of the intermediate transfer belt 41 is preferably in a range of from $10^6$ Ω/sq to $10^{12}$ Ω/sq, more preferably, in a range of from $10^8$ Ω/sq to $10^{12}$ Ω/sq. Furthermore, Young's modulus (modulus of longitudinal elasticity) of the base layer is preferably 3000 Mpa or more so that adequate mechanical strength to resist stretching, bending, creasing, and waving is obtained. With the use of such an elastic intermediate transfer belt, transferability of toner to a recording medium having a low paper fiber density and paper with a coarse surface such as embossed paper having an embossed groove depth of approximately 20 μm to 30 μm is enhanced because the elastic layer conforms to the shape of the recessed portion on the surface of the recording medium, thereby reliably transferring the toner to the recording medium.

As another example of the intermediate transfer belt, a single-layer belt may be used. Such a single-layer belt includes a resin layer having a medium electrical resistivity. The material of the belt includes, but is not limited to, polyimide (PI), polyamide-imide (PAI), polycarbonate (PC), ethylene tetrafluoroethylene (ETFE), polyvinylidene fluoride (PVDF), polyphenylene sulfide (PPS), and the like, the resistivity of which is adjusted by dispersing carbon or ion conductor. Alternatively, the single-layer belt thus obtained may be provided with a top layer having a high electrical resistivity which is slightly higher than the volume resistivity of the belt layer. The thickness of the top layer is preferably in a range of from 1 μm to 10 μm.

This type of belt controls the resistivity by dispersing carbon in the resin and is known to suppress a so-called "white void" generated on a recording medium during secondary transfer. More specifically, the moisture content of the recording medium decreases after fixing, which causes an increase in the resistivity of the recording medium. When the recording medium with the increased resistivity undergoes the secondary transfer process, white voids are generated on the recording medium. White voids refer to dropouts of toner which occur in a path through which the transfer current flows in a concentrated manner due to uneven dispersion of carbon in the belt. Consequently, the toner in the path is repelled, and hence the output image has white voids at the place corresponding to the path. With the high-resistivity layer provided to the surface of the belt, the local concentration of the transfer current is reduced, thereby reducing the white spots.

Next, a description is provided of relations between the primary transfer current and the primary transfer rate according to a first illustrative embodiment.

Figure 12:
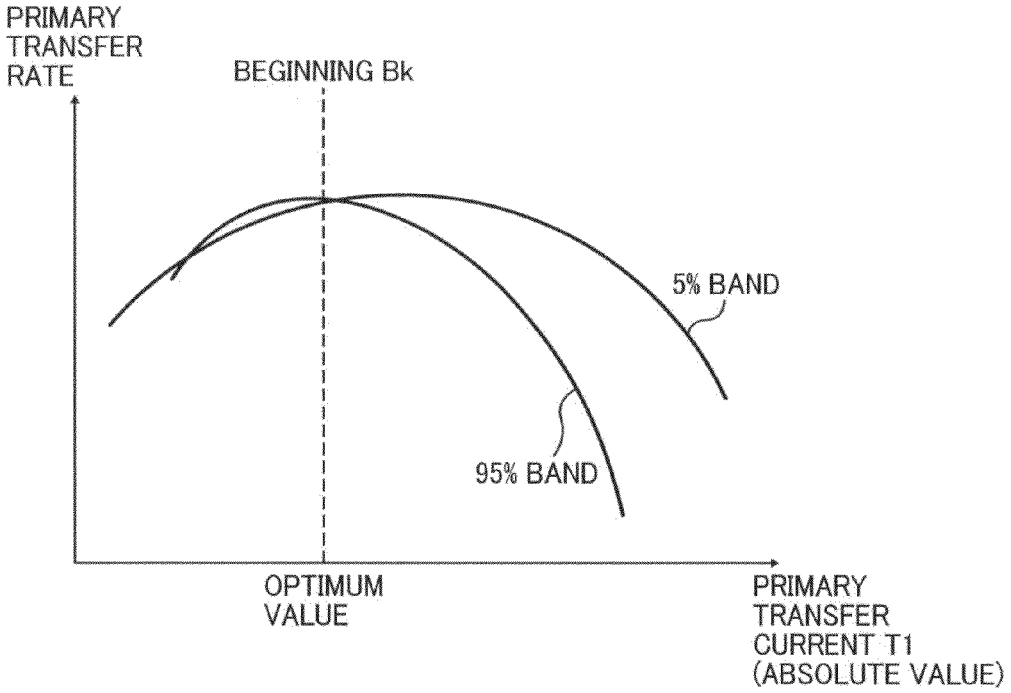
FIG. 12 is a graph showing relations between the primary transfer rate and the primary transfer current in the initial state in which the developing agent has not deteriorated yet.
Figure 13:
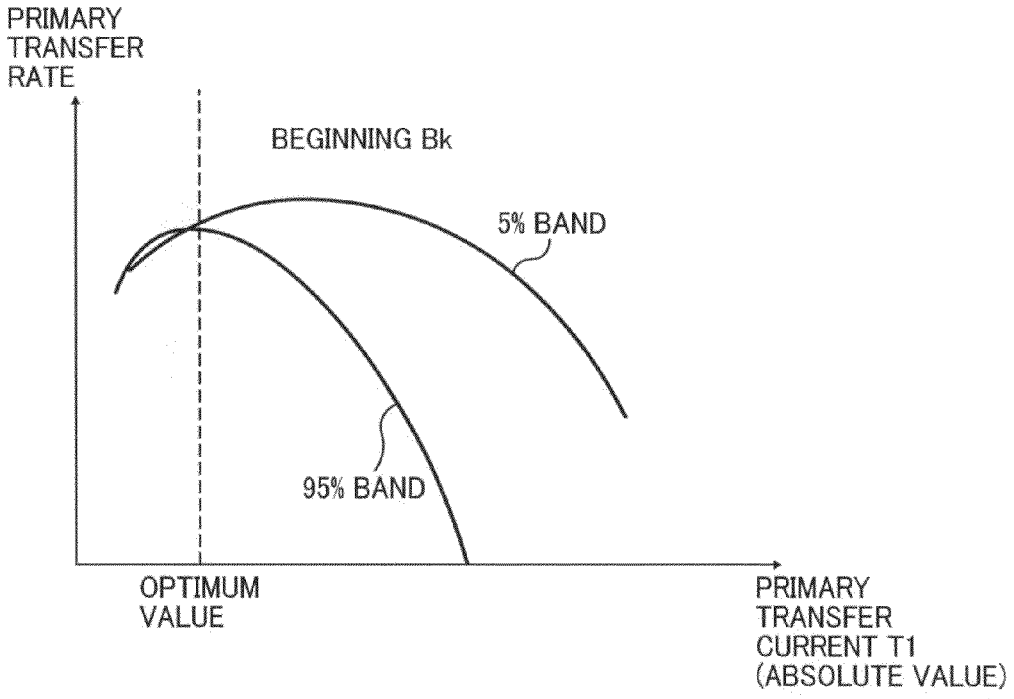
FIG. 13 is a graph showing relations between the primary transfer rate and the primary transfer current when the developing agent has deteriorated with time.
Figure 14:
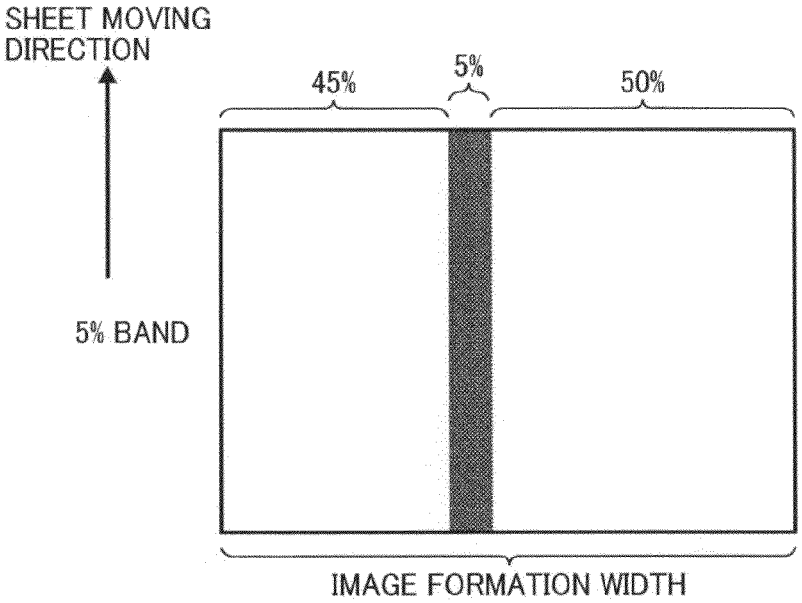
FIG. 14 is a conceptual diagram illustrating a 5% band image.
Figure 15:
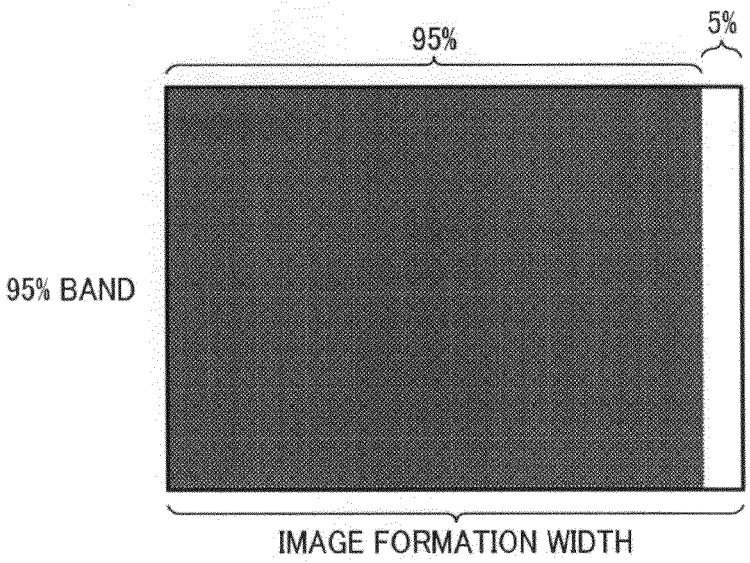
FIG. 15 is a conceptual diagram illustrating a 95% band image.
Figure 16:
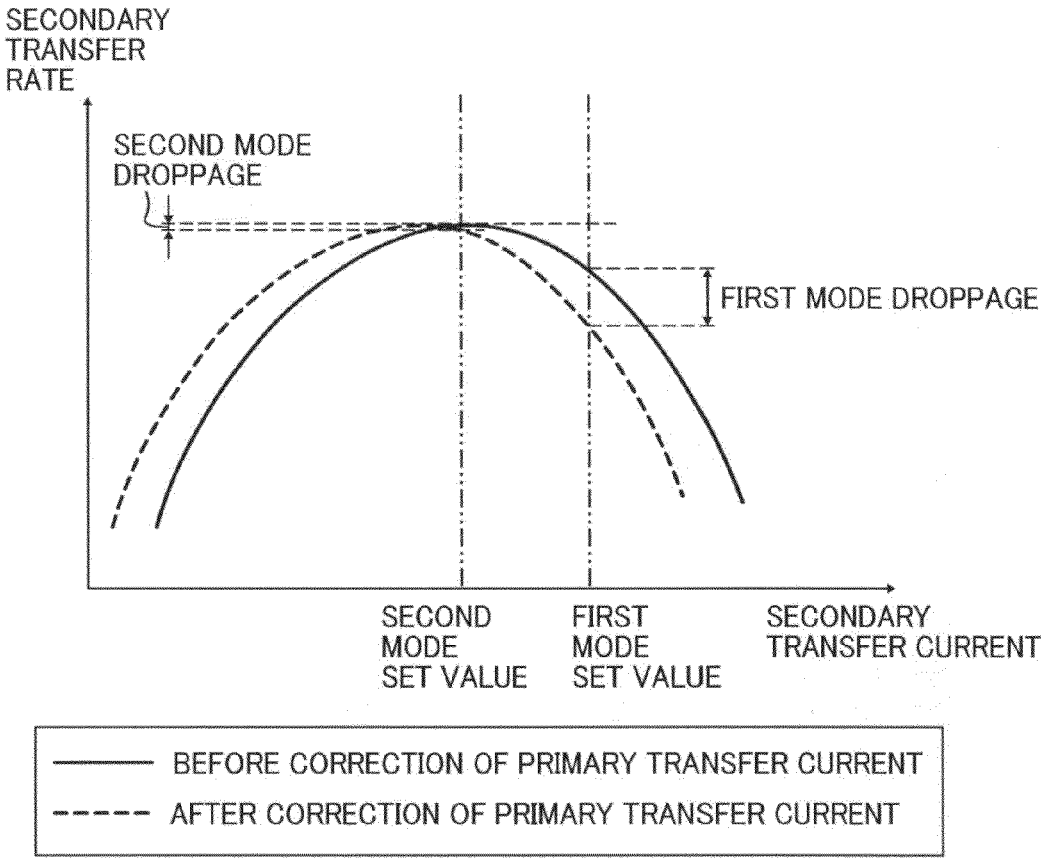
FIG. 16 is a graph showing relations between the secondary transfer rate and the secondary transfer current associated with a toner image on a downstream image bearing member.

In the first illustrative embodiment, a power source connected to the primary transfer rollers 45Y, 45C, 45M, and 45K is under constant current control so as to maintain a target current value (i.e., primary transfer current set value). In the constant current control, as shown in FIGS. 12 and 13, the relations between the primary transfer current and the primary transfer rate change depending on an image area ratio in the main scanning direction.

A non-image portion on the photosensitive drums 3Y, 3C, 3M, and 3K, at which no laser light L is illuminated, has a relatively large amount of electrical charge having the same polarity (in the present illustrative embodiment, a negative polarity) as that of toner. Thus, the primary transfer current flowing upon application of the primary transfer bias is used to attract the negative-charged toner and to attract the negative charge at the non-image portion. In general, the negative charge at the non-image portion has more electrical charge per unit area than the toner. Thus, with an increase in the area of the non-image portion, a greater amount of the primary transfer current needs to flow to transfer the same amount of toner to the intermediate transfer belt side. Therefore, as illustrated in FIGS. 12 and 13, a peak primary transfer current capable of obtaining the maximum primary transfer rate shifts to a higher primary transfer current side for a 5% band image than a 95% band image.

Similarly, deterioration of the developing agent with time and hence a decrease in the charge amount of toner have a pronounced influence on formation of an image with a high image area ratio in the main scanning direction. More specifically, as illustrated in FIG. 13, for the 95% band image using a deteriorated developing agent with time, the peak primary transfer current capable of achieving the maximum primary transfer rate shifts to the lower primary transfer current side. Therefore, when the charge amount of overall toner drops due to deterioration of the developing agent with time, the primary transfer current (peak) for achieving the maximum primary transfer rate in the 95% band image and the primary transfer current (peak) for achieving the maximum primary transfer rate in the 5% band image depart from each other. At this time, if an initial set value for the primary transfer current (optimum value shown in FIG. 12) is applied even after the developing agent deteriorated with time, the primary transfer rate in the 95% band image drops significantly and degradation of image quality becomes more pronounced. In particular, degradation of image quality in which an image density fluctuates significantly in accordance with the image area ratio of the output image becomes more significant. Therefore, it is desirable to correct the primary transfer current in accordance with the degree of deterioration of the developing agent.

Next, a description is provided of a secondary transfer rate.

Figure 3:
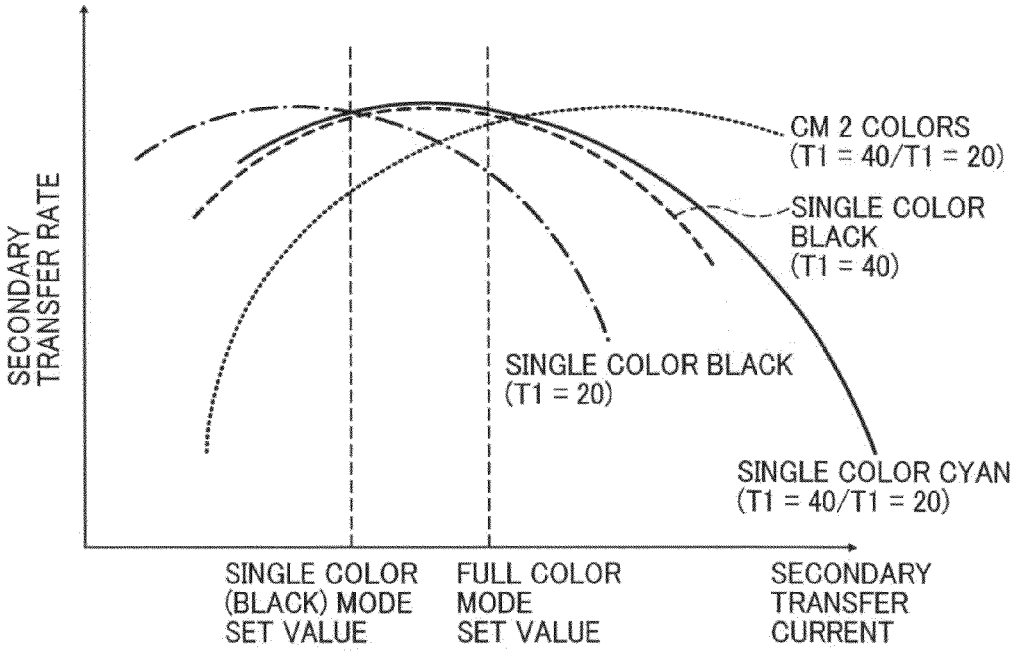
FIG. 3 is a graph showing relations of a secondary transfer current and a secondary transfer rate for a black toner image, a cyan toner image, and a two-color toner image with cyan and magenta when a primary transfer current is changed for the black toner image.

FIG. 3 is a graph showing relations of a secondary transfer current and a secondary transfer rate for a black single color toner image, a cyan single color toner image, and a two-color toner image with cyan and magenta when the primary transfer current is changed for the black toner image.

FIG. 3 shows a primary transfer current set value T1 being set to 20 μA (T1=20) and 40 μA (T1=40) for the photosensitive drum 3K disposed at the extreme downstream end in the moving direction of the intermediate transfer belt 41.

With respect to the black single color toner image, there is a significant difference in the relations of the secondary transfer current and the secondary transfer rate when the primary transfer current set value T1 is 20 μA and when the primary transfer current set value T1 is 40 μA. More specifically, when the primary transfer set value T1 for the color black is set to a higher value, i.e., 40 μA (T1=40), the secondary transfer current (peak) capable of achieving the maximum secondary transfer rate is at a higher secondary transfer current side. By contrast, when the primary transfer set value T1 for black is set to a lower value, i.e., 20 μA (T1=20), the secondary transfer current (peak) capable of achieving the maximum secondary transfer rate is at a lower secondary transfer current side.

With respect to the cyan single color toner image and the two-color toner image with cyan and magenta, there is no significant difference in the relations of the secondary transfer current and the secondary transfer rate when the primary transfer current set value T1 is 20 μA and when the primary transfer current set value T1 is 40 μA. Although the above example relates to the cyan single color toner image, the same or the similar result as the cyan single color image is expected for the magenta single color toner image and the yellow single color toner image.

With respect to the two-color toner image with cyan and magenta, the secondary transfer current (peak) capable of achieving the maximum secondary transfer rate is at a higher secondary transfer current side than the single color toner images such as the black single color toner image and the cyan single color toner image. The reason is as follows. Although the above example relates to the two-color toner image with cyan and magenta, the same or the similar result as the two-color toner image with cyan and magenta is expected for other color combinations consisting of two or more colors.

Figure 4:
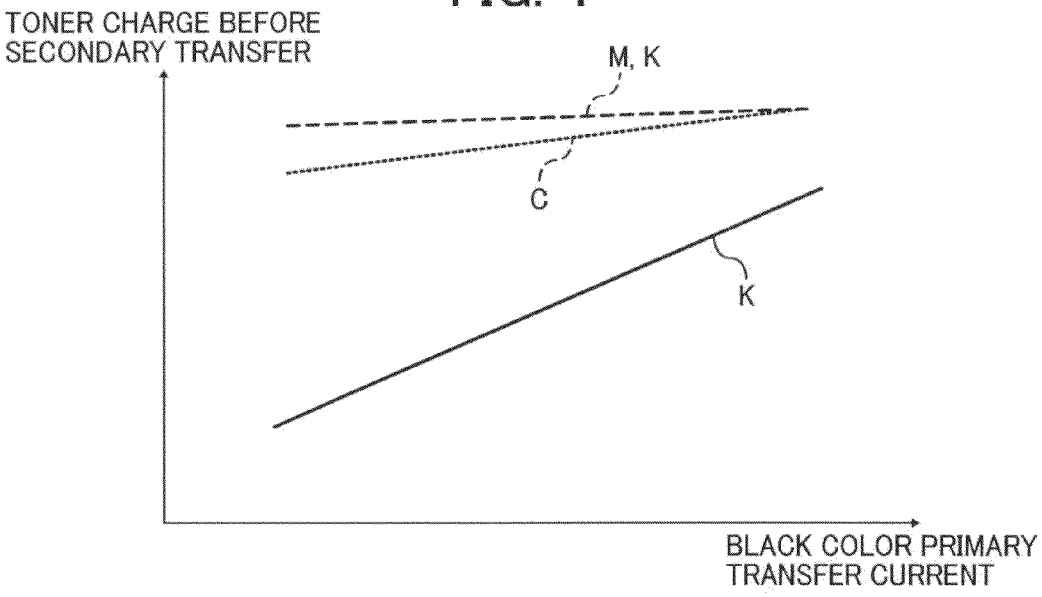
FIG. 4 is a graph showing relations of the primary transfer current for the black toner image and a charge amount of toner for each toner image before secondary transfer.

FIG. 4 a graph showing relations of the primary transfer current for the black toner image and the charge amount of toner for each toner image before secondary transfer.

With respect to the black toner image, as the primary transfer current for black is increased, the charge amount of toner (charge amount of toner before secondary transfer) on the intermediate transfer belt 41 increases at a large rate. By contrast, with respect to the cyan toner image, as the primary transfer current for black is increased, the charge amount of toner (charge amount of toner before secondary transfer) on the intermediate transfer belt 41 increases, but the rate of increase is less than the that of the black toner image. With respect to the magenta toner image and the cyan toner image, the charge amount of toner (charge amount of toner before secondary transfer) on the intermediate transfer belt 41 hardly changes relative to the changes in the primary transfer current for black.

The black toner image is formed on the photosensitive drum 3K disposed at the extreme downstream end in the moving direction of the intermediate transfer belt 41. Thus, toner not having been charged up by the primary transfer current gets charged up for the first time by the primary transfer current for the color black. As a result, the rate of increase in the charge amount of toner (charge amount of toner before secondary transfer) relative to the change in the primary transfer current for the color black is large.

By contrast, the cyan toner image is formed on the photosensitive drum 3C which is the second photosensitive drum from the extreme downstream end in the moving direction of the intermediate transfer belt 41. Thus, after the cyan toner image is charged by the primary transfer current during its own primary transfer, the cyan toner image is charged up by the primary transfer current for the color black. As a result, by the time the cyan toner image is charged up by the primary transfer current for the color black, the charge amount of toner has been increased to a certain level and the rate of increase in the charge amount (charge amount of toner before secondary transfer) of the cyan toner relative to the change in the primary transfer current for the color black is low.

Furthermore, the magenta toner image and the yellow toner image are formed on the photosensitive drums 3M and 3Y which are the third and fourth photosensitive drums from the extreme downstream end in the moving direction of the intermediate transfer belt 41, respectively. Thus, these toner images have been charged at least twice by the primary transfer current by the time these toner images are charged up by the primary transfer current for the color black. As a result, by the time these toner images are charged up by the primary transfer current for the color black, the charge amount of toner has been increased to a level substantially near the saturation level, and hence the rate of increase in the charge amount (charge amount of toner before secondary transfer) of the magenta and cyan toner is not influenced.

The higher is the charge amount of toner in the secondary transfer portion, that is, the higher is the charge amount of toner prior to secondary transfer, the more secondary transfer current is needed. Thus, as illustrated in FIG. 3, the peak value of the secondary transfer current for the cyan single color toner image capable of achieving the maximum secondary transfer rate is at a higher secondary transfer current side than that of the black single color toner image. The peak value of the secondary transfer current for the two-color toner image with cyan and magenta capable of achieving the maximum secondary transfer rate is at a higher secondary transfer current side than that of the cyan single color toner image.

Due to such tendencies, the value of the secondary transfer current in the full-color mode is set to achieve a highest possible secondary transfer rate within a range in which the secondary transfer rates for the plurality of toner images constituting the composite toner image are similar or substantially the same (that is, none of the secondary transfer rates has a low value relative to all the other ratios). More specifically, according to the present illustrative embodiment, as will be described later, the primary transfer bias adjuster 200*a* of the controller 200 adjusts, or more specifically reduces the primary transfer current for the color black with time (from T1=40 to T1=20). Accordingly, the set value for the secondary transfer current in the full-color mode is determined, for example, as similar to or the same values as shown in FIG. 3 in consideration of the secondary transfer rates for the black single color toner image, the cyan single color toner image, and the two-color toner image before and after the correction (in a case of T1=40 and T1=20).

By contrast, the set value for the secondary transfer current in the black single color mode (monochrome mode) needs to take only the secondary transfer rate for the black single color toner image into consideration. Therefore, the set value for the secondary transfer current in the black single color mode is determined to be similar or the same values as shown in FIG. 3 to achieve the highest possible secondary transfer rate within a range in which substantially the same secondary transfer rate can be achieved in consideration of the secondary transfer rate for the black toner image before and after the correction of the primary transfer current for the color black (in a case of T1=40 and T1=20).

According to the first illustrative embodiment of the present disclosure, the primary transfer current for the color black is adjusted to decrease with time (from T1=40 to T1=20). Accordingly, the secondary transfer current for achieving the maximum secondary transfer rate for the black single color toner image after the correction (in a case of T1=20) shifts towards the lower secondary transfer current side. At this time, in the single color mode for forming a single color toner image of black, the set value for the secondary transfer current is set so as not to change before and after the correction as described above. Therefore, in the black single color mode, even when the primary transfer current for the color black is adjusted to decrease, the secondary transfer rate for the black single color toner image formed in the black single color mode does not change. Accordingly, in the black single color mode, the primary transfer current for the color black is reduced to prevent degradation of image quality such as a decrease in the image density attributed to a decrease in the primary transfer rate due to a reduced overall charge amount of toner caused by the deterioration of the developing agent.

However, if the primary transfer current for the color black is reduced in the full-color mode in the similar manner as in the black single color mode, there is a possibility that the degradation of image quality is not prevented, but rather may be worsened.

As described above, in the full-color mode, the secondary transfer current is set as shown in FIG. 3. With such a set value for the secondary transfer current shown in FIG. 3, reducing the primary transfer current for the color black with time (from T1=40 to T1=20) causes the secondary transfer rate for the black single color toner image after correction (when T1=20) to drop significantly from the secondary transfer rate before the correction. Consequently, in the full-color mode, reducing the primary transfer current for the color black in accordance with the degree of deterioration of the developing agent causes the secondary transfer rate for the black toner image formed in the full-color mode to drop significantly as compared with the secondary transfer rate thereof before the adjustment, hence causing degradation of image quality such as a reduced image density of the color black and a change in the color balance relative to other colors. Thus, if the primary transfer current for the color black is reduced in the full-color mode in the similar manner as in the black single color mode, there is a possibility that the degradation of image quality is not prevented, but rather may be worsened.

In view of the above, according to the first illustrative embodiment of the present disclosure, the degree of deterioration of the black developing agent is detected by the developing agent condition detector 200K and the primary transfer current for the color black is adjusted by a certain amount corresponding to the degree of deterioration in the black single color mode. However, in the full-color mode, such an adjustment of the primary transfer current for the color black is not performed, or the primary transfer current for the color black is adjusted by a smaller correction amount than the black single color mode.

Furthermore, according to the first illustrative embodiment, the degree of deterioration of other developing agents such as for the colors cyan, magenta, and yellow, other than the black developing agent is detected individually by the developing agent condition detectors 200C, 200M, and 200Y and the set value for each primary transfer current is adjusted by a certain amount corresponding to the deterioration of the respective developing agent. The primary transfer current adjustment may be performed in the black single color mode and in the full-color mode. However, in a case in which the same failure as in the adjustment of the primary transfer current for the color black occurs, in the full-color mode, such an adjustment of the primary transfer current is not performed for the second color, i.e., cyan, or in some cases the third color, i.e., magenta from the extreme downstream end in the moving direction of the intermediate transfer belt 41, or the primary transfer current for cyan or magenta is adjusted by a smaller correction amount than the respective single color mode.

According to the first illustrative embodiment, the set value for the secondary transfer current may be set unchangeable in accordance with the degree of deterioration of the developing agent. Alternatively, the set value for the secondary transfer current may be changed in accordance with other conditions. Preferably, the secondary transfer bias adjustor 200*b* adjusts the set value for the secondary transfer current in accordance with the degree of deterioration of the black developing agent in the image forming unit 1K disposed at the extreme downstream end in the moving direction of the intermediate transfer belt 41 or in accordance with the adjustment of the set value for the primary transfer current for the color black. In this case, preferably, the amount of adjustment (correction) of the secondary transfer current is greater in the black single color mode than in the full-color mode.

Figure 5:
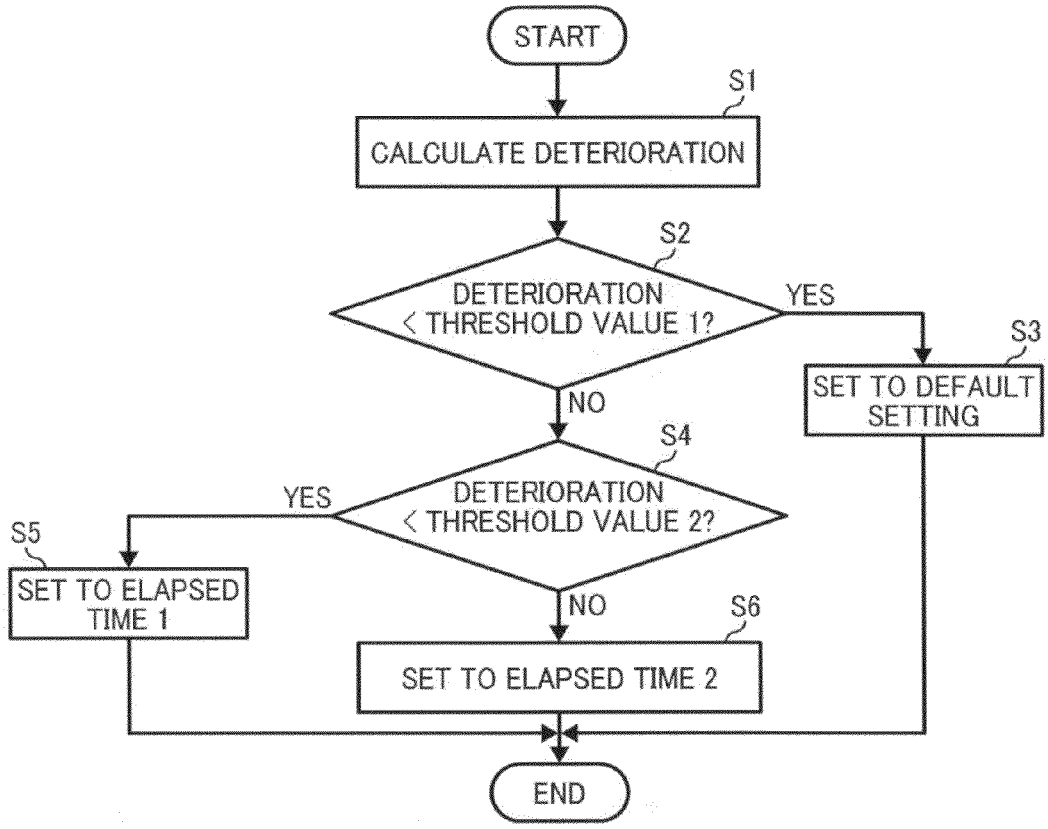
FIG. 5 is a flowchart showing steps in a process of determination of an amount of correction in accordance with a degree of deterioration of a developing agent.

FIG. 5 is a flowchart showing steps in a process of determination of an amount of adjustment (correction) in accordance with a degree of deterioration of a developing agent.

FIG. 6 is a table showing an example of set values of the primary transfer current for each color in accordance with the degree of deterioration of the developing agent and set values of the secondary transfer current.

In the first illustrative embodiment, in order to determine the degree of deterioration of the developing agent of each color, the degree of deterioration of the developing agent is compared with a preset threshold value. In the first illustrative embodiment, the degree of deterioration of the developing agent is classified into three groups: "INITIAL STATE", "ELAPSED TIME 1", and "ELAPSED TIME 2".

More specifically, as illustrated in FIG. 5, the degree of deterioration of the developing agent is calculated at step S1 (S1). In the first illustrative embodiment, a degree of deterioration of the developing agent refers to deterioration of the developing agent in terms of chargeability of toner. Because direct observation of such a degree of deterioration of the developing agent is difficult, parameters that are in correlation with the degree of deterioration of the developing agent are used to detect the degree of deterioration of the developing agent in directly.

The parameters to obtain the degree of deterioration of the developing agent include, but are not limited to a number of passing sheets, a travel distance of the development roller 12 (a drive distance of the surface of the development roller 12 in the circumferential direction), a total amount of consumption of toner consumed in the development unit 7 detected by the toner density detector 10Y, and an elapsed time from a time at which a new developing agent is set to the development unit. At least one parameter or a combination of two or more parameters that are in correlation with the degree of deterioration of the developing agent is used. A gradient (development y) of an amount of development relative to the development bias or the like upon adjustment of image quality (upon process control) is in correlation with the degree of deterioration of the developing agent and hence can be used as a parameter to obtain the degree of deterioration of the developing agent.

In a configuration in which replacement of parts in the development unit 7 and the photosensitive drum unit 2 is carried out together as a set, chronological change characteristics of the photosensitive drum (travel distance of the photosensitive drum 3) is in correlation with the degree of deterioration of the developing agent and hence can be used as a parameter to obtain the degree of deterioration of the developing agent. According to the present illustrative embodiment, a value obtained in the following equation is used as an example of the degree of deterioration of the developing agent.

DEGREE OF DETERIORATION OF DEVELOPING AGENT=NUMBER OF SHEETS PASSED[kp]× TOTAL AMOUNT OF TONER CONSUMPTION[kg] [EQUATION 1]

With a large number of passing sheets, the development unit 7 operates longer and the developing agent in the development unit 7 is mixed by the first conveyor screw 8Y and the second conveyor screw 11Y, thereby increasing the degree of deterioration of the developing agent. In particular, the more is the developing agent that is mixed, the more toner particles separate from an additive, causing the additive to stick to the surface of carrier particles, thereby reducing the chargeability of the toner. As a result, the degree of deterioration of the developing agent increases.

It is known that the degree of deterioration of the developing agent is in high correlation with the total amount of toner consumption. That is, the degree of deterioration of the developing agent increases proportionally with the total amount of toner consumption. Therefore, not only the total number of sheets passing, but also the total amount of toner consumption is used as a parameter for calculation of the degree of deterioration of the developing agent.

In the first illustrative embodiment, a two-component developing agent consisting of toner and carrier is employed. Thus, the cause of the deterioration of the developing agent can be classified roughly into two categories. One is a decrease in chargeability of toner attributed to deterioration of the toner itself, and another is a decrease in chargeability of toner attributed to the carrier. In the first illustrative embodiment, the degree of deterioration of the developing agent is detected by focusing on the decrease in the chargeability of toner attributed to the carrier. When the amount of toner consumed during printing of a certain number of sheets is equal to or less than a specified amount, the toner in the development unit is discharged forcibly to the photosensitive drum 3, thereby replacing the old toner in the development unit 7 with the new toner in toner replacement control. Therefore, the deterioration of toner itself does not affect the decrease in the charge amount of toner much. In view of this, in the first illustrative embodiment, the degree of deterioration of the developing agent is detected by focusing on the decrease in the chargeability of toner attributed to the carrier.

Referring back to FIG. 5, after calculation of the degree of deterioration of the developing agent, next, whether the degree of deterioration of the developing agent is less than a threshold value 1 is determined at step S2. When the degree of deterioration is determined to be less than the threshold value 1 (YES, S2), the degree of deterioration of the developing agent is classified as "INITIAL STATE" at step S3 (S3). When the degree of deterioration is equal to or greater than the threshold value 1 (NO, S2), whether the degree of deterioration of the developing agent is less than a threshold value 2 is determined at step S4 (S4). When the degree of deterioration is determined to be less than the threshold value 2 (YES, S4), the degree of deterioration of the developing agent is classified as "ELAPSED TIME 1" at step S5 (S5). When the degree of deterioration is equal to or greater than the threshold value 2 (NO, S4), the degree of deterioration of the developing agent is classified as "ELAPSED TIME 2" at step S6 (S6). The threshold value 1 and the threshold value 2 for determination of the degree of deterioration of the developing agent are, for example, 10[kp×kg] and 50 [kp×kg], respectively.

In this configuration, the degree of deterioration of the developing agent for each of the colors yellow, magenta, cyan, and black is classified independently into three categories: INITIAL, ELAPSED TIME 1, and ELAPSED TIME 2.

In the first illustrative embodiment, a table illustrated in FIG. 6 showing the relations between the degree of deterioration of the developing agent (time group), the set values for the primary transfer current for each color in each mode, and the set value for the secondary transfer current is stored in the storage device in advance. The controller 200 of the first illustrative embodiment enables application of the primary transfer current and the secondary transfer current to meet the respective set values for the primary transfer current and the secondary transfer current specified by the table in accordance with the calculated degree of deterioration of the developing agent (time group) as described above in accordance with the control mode upon image forming operation.

In the first illustrative embodiment, as illustrated in FIG. 6, the correction amount of the primary transfer current of the image forming unit 1K for the color black disposed at the extreme downstream end in the moving direction of the intermediate transfer belt 41 in accordance with the degree of deterioration of the developing agent (time group) in the black single color mode is less than that in the full-color mode. With this configuration, in the black single color mode in which the influence of the change (correction) in the set value of the primary transfer current on the secondary transfer rate is relatively small, the degradation of image quality attributed to the decrease in the primary transfer rate associated with the deterioration of the developing agent can be suppressed properly. Furthermore, in the full-color mode in which the influence of the change (correction) in the set value of the primary transfer current on the secondary transfer rate for the color black is significant, by reducing the amount of correction of the primary transfer current the influence on the secondary transfer rate can be suppressed and the degradation of overall image quality can be prevented.

The principle of the amount of correction of the secondary transfer current is the same that of the primary transfer current.

AMOUNT OF CORRECTION=(INITIAL VALUE−VALUE AFTER CORRECTION)/INITIAL VALUE [EQUATION 2]

According to the present illustrative embodiment, in the full-color mode, the amount of correction of the primary transfer current for the color black in accordance with the degree of deterioration of the developing agent (time group) is less than in the black single color mode. Alternatively, however, as illustrated in FIG. 7, in the full-color mode, the primary transfer current for the color black does not have to be corrected in accordance with degree of deterioration of the developing agent (time group). In this case, in the full-color mode, there is no need to change (adjust) the setting of the primary transfer current for the color black in accordance with the degree of deterioration of the developing agent (time group), thereby allowing simplification of the control.

Furthermore, as illustrated in FIG. 6, the amount of correction of the secondary transfer current in accordance with the degree of deterioration of the developing agent (time group) is greater in the black single color mode than in the full-color mode. As illustrated in FIG. 3, the secondary transfer current (peak) capable of achieving the maximum secondary transfer rate for the two-color toner image with cyan and magenta is hardly affected even when the primary transfer current for the color black is changed. The same result is obtained when the primary transfer current for other colors is changed. Because the same result as the two-color toner image is obtained for the four-color toner image, in the full-color mode there is less need to adjust the secondary transfer current in accordance with the adjustment of the primary transfer current. However, since the secondary transfer rate for the black toner image drops significantly due to adjustment of the primary transfer current, it is preferable to make some adjustments in the full-color mode.

In the black single color mode, as illustrated in FIG. 3, the adjustment of the primary transfer current causes the secondary transfer current (peak) for achieving the maximum secondary transfer rate for the black single color toner image to shift towards the lower secondary transfer current side. Thus, as in the first illustrative embodiment, when setting the secondary transfer current to achieve the maximum secondary transfer rate in the initial state, Elapsed Time 1, and Elapsed Time 2, the amount of change (correction) in the setting is greater in the black single color mode than in the full-color mode.

Furthermore, in the first illustrative embodiment, the amount of adjustment (correction) of the primary transfer current in the image forming units 1Y, 1M, and 1C for the colors yellow, magenta, and cyan, respectively, disposed upstream from the image forming unit 1K for the color black which is disposed at the extreme downstream end in the moving direction of the intermediate transfer belt 41 is greater than the amount of adjustment (correction) of the primary transfer current for the color black in the image forming unit 1K. The reason is as follows.

The toner images primarily transferred from the image forming units 1Y, 1M, and 1C disposed upstream from the image forming unit 1K are charged up by the primary transfer current of the downstream image forming unit 1K, and advance to the secondary transfer portion. Consequently, even when the primary transfer current of the image forming units 1Y, 1M, and 1C is changed upon primary transfer, the charge amount of toner of the primarily transferred toner images is less affected so that the secondary transfer rate is less affected. Therefore, the primary transfer current of the image forming units 1Y, 1M, and 1C in the upstream side is adjusted while taking into consideration of only improving the primary transfer rate which decreases in accordance with the degree of deterioration of the developing agent for each color.

By contrast, when the primary transfer current for the color black is changed upon primary transfer, the charge amount of toner of the primarily transferred black toner image drops significantly when the black toner image arrives at the secondary transfer portion, thereby affecting significantly the secondary transfer rate. Therefore, the primary transfer current of the image forming unit 1K at the extreme downstream end needs to be adjusted (corrected) while taking into consideration of both enhancement of the primary transfer rate as well as the decrease in the secondary transfer rate for the toner image of the color black. In view of the above, in the first illustrative embodiment, in the full-color mode, the primary transfer current for the colors yellow, magenta, and cyan is greater than that for the color black.

Next, a description is provided of a variation of adjustment control of the secondary transfer current in the first illustrative embodiment.

In the present variation, in accordance with an image area ratio of each of the toner images, a set value of the secondary transfer current is changed.

In the first illustrative embodiment, the secondary transfer bias is under constant current control. Thus, similar to the relations between the primary transfer current and the primary transfer rate, the relations between the secondary transfer current and the secondary transfer rate change depending on the image area ratio. That is, the secondary transfer current capable of achieving the optimum secondary transfer rate depends on the image area ratio.

In view of the above, according to the present illustrative embodiment, the set value of the secondary transfer current is adjusted (corrected) in accordance with the image area ratio. However, as can be understood from FIG. 3, in the full-color mode, the secondary transfer current (peak) capable of achieving the maximum secondary transfer rate for the toner image of the color black and the secondary transfer current (peak) capable of achieving the maximum secondary transfer rate for the toner images of the colors yellow, cyan, and magenta separate from each other due to charging up by the primary transfer current. According to the present illustrative embodiment, in order to accommodate such separation of peaks, the adjustment control of the secondary transfer current in accordance with the image area ratio is changed in accordance with the degree of deterioration of the developing agent in the full-color mode. It is to be noted that in the black single color mode, the adjustment control of the secondary transfer current in accordance with the image area ratio is not changed in accordance with the degree of deterioration of the developing agent.

Figure 8:
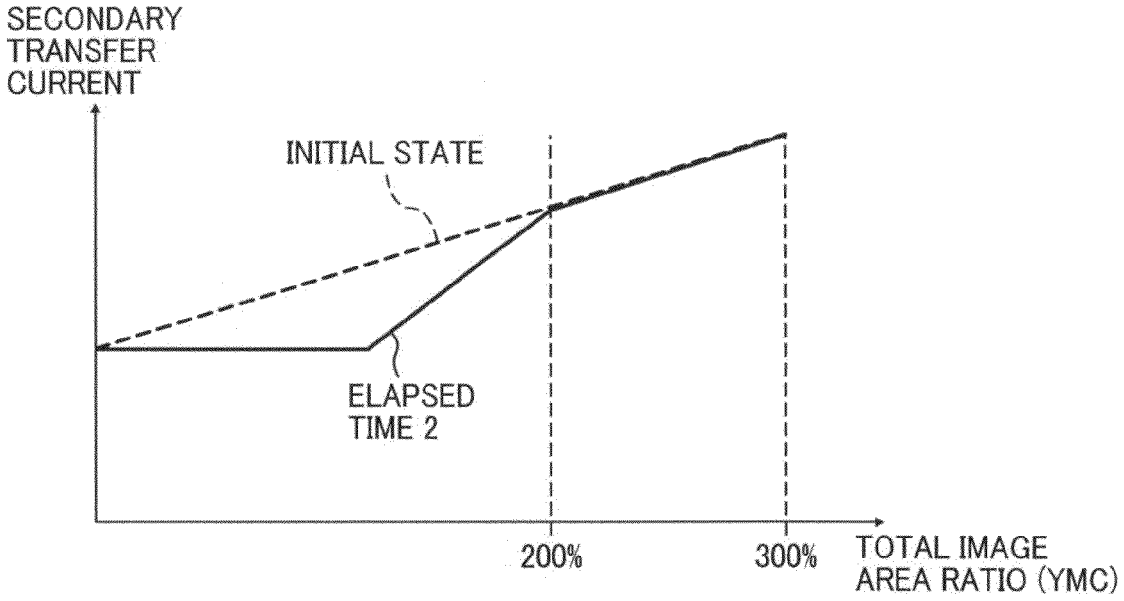
FIG. 8 is a graph showing an example of a change in the secondary transfer current setting according to a variation.

FIG. 8 is a graph showing an example of a change in the secondary transfer current setting according to the variation.

In general, the greater is the amount of toner that is present in the secondary transfer portion, the more secondary transfer current is needed. In view of the above, in the variation, first, an image area ratio of an image formed on a sheet of recording medium is obtained for each of the colors yellow, magenta, and cyan. The image area ratios thus obtained are summed and the result is referred to as an image area ratio of the image (hereinafter referred to as total image area ratio). The image area ratio for each of the colors is a ratio of a portion to which the toner image of the respective color adheres relative to the entire image area in the image on the sheet of recording medium. When the toner image of the respective color adheres to the entire image area, the image area ratio of the respective color is 100%. Thus, in the variation, when the image area ratio of each of the colors yellow, magenta, and cyan is 100%, the total image area ratio is the maximum 300%.

In the variation, after a controller which performs imaging processing performs color separation processing, the image area ratios of each of the colors yellow, magenta, and cyan are calculated and summed, thereby obtaining the total image area ratio. In accordance with the obtained total image area ratio, the secondary transfer current is set in accordance with the control shown in FIG. 8.

A broken line in FIG. 8 shows relations between the image area ratio and the set value of the secondary transfer current in the initial state in which the degree of deterioration (time group) of the developing agent is at an initial phase. A solid line in FIG. 8 shows relations between the image area ratio and the set value of the secondary transfer current when the degree of deterioration (time group) of the developing agent is at Elapsed Time 2. Although not shown, when the degree of deterioration (time group) of the developing agent is at Elapsed Time 1, an average of the initial state and Elapsed time 2 becomes the set value of the secondary transfer current.

As shown in FIG. 8, in the initial state in which the developing agent has not deteriorated, the secondary transfer current is set to be proportional to the total image area ratio. By contrast, after an elapse of time, that is, after the developing agent deteriorated, as shown in FIG. 8, the secondary transfer current is adjusted such that the gradient of the secondary transfer current relative to the total image area ratio is relatively small, in particular, when the total image area ratio is low. More specifically, when the total image area ratio is 200% or more, it can be assumed that the substantially entire image area is covered with toner of yellow, cyan, and magenta. Thus, after an elapse of time, simply the secondary transfer current in accordance with the total amount of toner to enter the secondary transfer portion is supplied without considering the black toner, which is the same control as in the initial state.

By contrast, when the total image area ratio is less than 200%, the secondary transfer current is controlled such that the higher is the degree of deterioration of the developing agent, the lower is the secondary transfer current. In this configuration, even when the secondary transfer rate of the toner images of the colors yellow, magenta, and cyan is decreased to some extent, the secondary transfer current is prevented from being supplied excessively for the black toner and hence good image quality is obtained entirely. At this time, in the area with the total image area ratio of nearly 200%, the toner images of the colors yellow, magenta, and cyan have a high image area ratio so that the secondary transfer current is controlled to rise quickly. However, in the area with a lower total image area ratio, the toner images for the colors yellow, magenta, and cyan do not need the secondary transfer current much. Thus, the secondary transfer current thereof has almost no gradient.

With this control, in the event of forming an image with a relatively low image area ratio such as an image including a toner image of the color black in the full-color mode, a relatively low secondary transfer current is used in second transfer to obtain good image quality for the color black. By contrast, in an image with a relatively high total image area ratio, the colors yellow, magenta, and cyan are dominant. Thus, higher priority is given to the secondary transfer rate for the colors yellow, magenta, and cyan than the color black, thereby obtaining good image quality for the colors yellow, magenta, and cyan.

In the present variation, the total image area ratio relative to the entire image area on a sheet of recording medium is used. Alternatively, an image area on a sheet of recording medium is segmented into a plurality of areas in the direction of conveyance of the recording medium (sub-scanning direction), and the secondary transfer current to be supplied to each area that is present in the secondary transfer portion is controlled individually based on the total image area ratio of each segmented area.

Next, with reference to FIGS. 9 through 11, a description is provided of evaluation tests to evaluate effectiveness of the illustrative embodiment of the present disclosure.

In the evaluation tests performed by the present inventors, the image density was evaluated on all-solid single color images (image area ratio of 100%) of the colors black and cyan, a two-color solid image with cyan and magenta, and small toner patches having a size of 15 mm×15 mm for the colors black and cyan, and a two-color toner patch of cyan and magenta, each of which was formed on a sheet of recording medium.

In the first illustrative embodiment, as described above, both the set value of the primary transfer current and the set value of the secondary transfer current are adjusted or corrected in accordance with the degree of deterioration (time group) of the developing agent.

In a second illustrative embodiment using an image forming apparatus having the same configuration as shown in FIG. 1, as described in the variation, both the set value of the primary transfer current and the set value of the secondary transfer current are adjusted or corrected in accordance with the degree of deterioration (time group) of the developing agent, and further the secondary transfer current in the full-color mode is set in accordance with the total image area ratio.

In a third illustrative embodiment using an image forming apparatus having the same configuration as shown in FIG. 1, the set value of the primary transfer current is adjusted or corrected in accordance with the degree of deterioration (time group) of the developing agent similar to the first illustrative embodiment, but the set value of the secondary transfer current employed in the initial state remains unchanged even after an elapse of time.

In a comparative example 1 using an image forming apparatus having the same configuration as shown in FIG. 1, the set value of the primary transfer current and the set value of the secondary transfer current used in the initial state remain unchanged even after an elapse of time.

In a comparative example 2 using an image forming apparatus having the same configuration as shown in FIG. 1, the set value of the primary transfer current used in the initial state remains unchanged, and the set value of the secondary transfer current is adjusted or corrected in accordance with the degree of deterioration (time group) of the developing agent such as in the first illustrative embodiment.

FIG. 9 is a table showing results of evaluation of the image density when the degree of deterioration of the developing agent is in the initial state.

FIG. 10 is a table showing results of evaluation of the image density when the degree of deterioration of the developing agent is in ELAPSED TIME 1.

FIG. 11 is a table showing results of evaluation of the image density when the degree of deterioration of the developing agent is in ELAPSED TIME 2.

In the comparative examples 1 and 2 in which the primary transfer current was not adjusted or corrected in accordance with the degree of deterioration of the developing agent, the primary transfer rate for the all-solid single color images of the colors black and cyan dropped, and the image density thereof dropped significantly from the initial state. The image density was evaluated as POOR.

By contrast, in the first and second illustrative embodiments, the same image density as in the initial state was maintained for the all-solid single color images as well as the small toner patches of the colors black and cyan, the two-color solid image, and the two-color small toner patch even after an elapse of time.

In the third illustrative embodiment in which the secondary transfer current was not adjusted or corrected in accordance with the degree of deterioration of the developing agent, the secondary transfer rate for the two-color solid image and the small toner patch of the color black dropped, and the image density thereof dropped slightly from the initial state after an elapse of time. However, the image density after degradation was still acceptable. Thus, the image density was evaluated as FAIR.

Suitable toner for use in the above-described image forming apparatuses according to exemplary embodiments is described in detail below.

In order to obtain desirable charge on toner through charging in the development unit and through charging-up in the transfer portion, it was assumed that using the toner having a volume resistivity greater than 10.7 log Ωcm was preferable. However, in recent years, there is toner having the volume resistivity of 10.7 log Ωcm or less in order to secure fixation ability, in particular, at low temperature. Thus, there is demand for an image forming apparatus capable of providing good image quality using such toner. The toner having a relatively low volume resistivity has a characteristic in that this type of toner is difficult to keep the charge. It is assumed that an apparent electrostatic capacity decreases when electrical resistance decreases. Consequently, as the toner charging ability of carrier decreases with time, the charge amount of toner having a low volume resistivity drops easily as compared with toner having a high volume resistivity.

Due to decrease in the charge amount of toner with time, as described above, the optimum secondary transfer current of an image having, in particular, a high image area ratio (such as an all-solid single color image) in the initial state and the optimum secondary transfer current after an elapse of time separate from one another. As a result, the black toner is overcharged with time, thereby reducing the image density of the color black. In this case, reducing the primary transfer current and the secondary transfer current with time is effective as described above.

Furthermore, a degree of tolerance of the primary transfer rate and the secondary transfer rate relative to the transfer current differs depending on the volume resistivity. If the target primary transfer rate and secondary transfer rate is 90% or more, as one example, when using toner having a volume resistivity of 10.9 log Ωcm, the transfer current in a range of from 9 μA and 24 μA can be used. By contrast, when using toner having a volume resistivity of 10.7 log Ωcm, the transfer current only in a range of from 9 μA and 21 μA can be used.

The transfer current capable of achieving an optimum transfer rate changes depending on the charge amount of toner, the electrical potential of the photosensitive drum, the image area ratio in the main scanning direction, the resistance of the intermediate transfer belt and the transfer roller, and so forth. Thus, if the range of usable transfer current is narrow, the transfer current needs to be set more precisely. In view of the above, when using the toner having the volume resistivity of equal to or less than 10.7 log Ωcm, it is very effective to adjust or correct the transfer current in accordance with changes in the charge amount of toner with time as in the first illustrative embodiment.

The volume resistivity of toner varies between colors. For example, because color material (pigment) in toner is different for each color, the volume resistivity of toner is different for each color when using four different colors of toner such as in the image forming apparatus of the first illustrative embodiment. In particular, when the black toner is colored with carbon, the volume resistivity thereof is lower than that of other colors of toners such as yellow, magenta, and cyan. More specifically, in a case in which carbon black is used as a coloring agent for the black toner, the volume resistivity of the black toner is approximately 10.7 log Ωcm.

Specific examples of the coloring agent for the toner of the colors yellow, cyan, and magenta include, but are not limited to, aniline blue, phthalocyanine blue, phthalocyanine green, hansa yellow G, rhodamine 6g Lake, calco oil blue, chrome yellow, quinacridone, benzidine yellow, rose bengal, and triarylmethane. These materials can be used alone or in combination. The volume resistivity of these toners is approximately 10.9 log Ωcm.

In this case, the charge amount of the black toner is lower than that of other colors. Thus, in the full-color mode, only the black toner is overcharged easily in the secondary transfer, resulting easily in degradation of an image such as inadequate transfer of black toner and hence thinning the black color in the resulting image. Furthermore, in order to shorten the first print time in the black single color mode (monochrome mode), in the tandem-type image forming apparatus using an intermediate transfer method, generally, the image forming unit 1K for the color black is disposed at the extreme downstream end. As described above, the toner image in the image forming unit 1K disposed at the extreme downstream end does not get charged up by the primary transfer current of other image forming units. The charge amount of toner of the toner image of the color black in the secondary transfer portion is lower than that of other toner images produced in the image forming units disposed upstream from the image forming unit 1K.

The black toner originally has a low volume resistivity. In addition, because the image forming unit 1K is disposed at the extreme downstream end, the charge amount of the toner in the secondary transfer portion is relatively low so that degradation of an image in which the color of black in the image appears light occurs easily. Therefore, according to the illustrative embodiment, adjustment of the transfer current in accordance with changes in the charge amount of toner with time is very effective in a configuration in which the image forming unit 1K of the color black is disposed at the extreme downstream end.

Transferring secondarily the toner image having the low charge amount also causes scattering of toner during conveyance of the recording medium. When performing the secondary transfer under the same control as the conventional transfer current control, toner having the low charge amount is transferred secondarily onto a recording medium. In general, electrostatic absorption power of toner having a higher charge amount relative to the recording medium is higher. Thus, the toner having a higher charge amount is transferred well, hence reducing scattering of toner. By contrast, the toner having a low charge amount causes easily scattering of toner on the conveyor guide or the like. Therefore, increasing the primary transfer current is effective in increasing the charge amount of toner on the intermediate transfer belt. However, as pointed out, the optimum primary transfer current (i.e., the primary transfer current capable of achieving a high primary transfer rate) shifts towards the lower primary transfer current side when the charge amount of toner decreases, thereby complicating efforts to increase the primary transfer current.

In view of the above, reducing the secondary transfer current is effective in that the charge amount of the recording medium is reduced, thereby getting less susceptible to toner scattering during transfer. Normally, electric discharge in the secondary transfer portion charges the recording medium. Thus, with a low secondary transfer current, the charge amount of the recording medium can be low. The scattering of toner during conveyance of the recording medium becomes pronounced in the monochrome mode, which is different from the difference in the secondary transfer ability for the color black and that of other colors.

The above-described difficulty attributed to the decrease in the charge amount of toner is pronounced when using the toner with a low volume resistivity, in particular, the volume resistivity of equal to or less than 10.7 log Ωcm. However, by performing the control or adjustment according to the first illustrative embodiment, the toner with a low volume resistivity can be treated the same way as the toner with a high volume resistivity such as conventional toner. Obviously, the toner with a high volume resistivity has similar difficulty more or less. Thus, the control or adjustment according to the first illustrative embodiment is effective for the toner with a high volume resistivity to prevent image defects.

Further, the present disclosure is not limited to these embodiments, but various variations and modifications may be made without departing from the scope of the present invention. For example, in the first illustrative embodiment, the primary transfer bias is applied under constant current control, and the primary transfer bias is adjusted by adjusting a target current value under the constant current control. Alternatively, in a case in which the primary transfer bias is applied under constant voltage control the primary transfer bias may be adjusted by adjusting the voltage value. The same can be said of adjustment of the secondary transfer bias. The secondary transfer bias may be adjusted by adjusting the current value or the voltage value.

Now, a description is provided of a second illustrative embodiment.

It is to be noted that although an example is provided of control of the transfer bias using the current value, the same can be said of the control using the voltage value and thus the control is not limited thereto.

In general, the greater is the transfer current, the higher is the transfer rate, hence transferring more toner to a transfer medium. Although advantageous, when more of the transfer current is increased than necessary, degradation of image quality occurs in primary transfer and/or secondary transfer. For example, the transfer rate may drop and the transferred toner image has uneven image density.

A developing agent deteriorates as image forming operation is repeated, and in general the charge amount (Q/M) of toner in the developing agent decreases gradually. With the decrease in the charge amount of toner, as described above, the optimum transfer current (i.e., primary transfer current) required to transfer the toner image from the photosensitive drum to the transfer medium changes. Therefore, it is desirable that the primary transfer current be adjusted or corrected in accordance with the degree of deterioration of the developing agent to prevent degradation of image quality attributed to deterioration of the developing agent.

Figure 18:
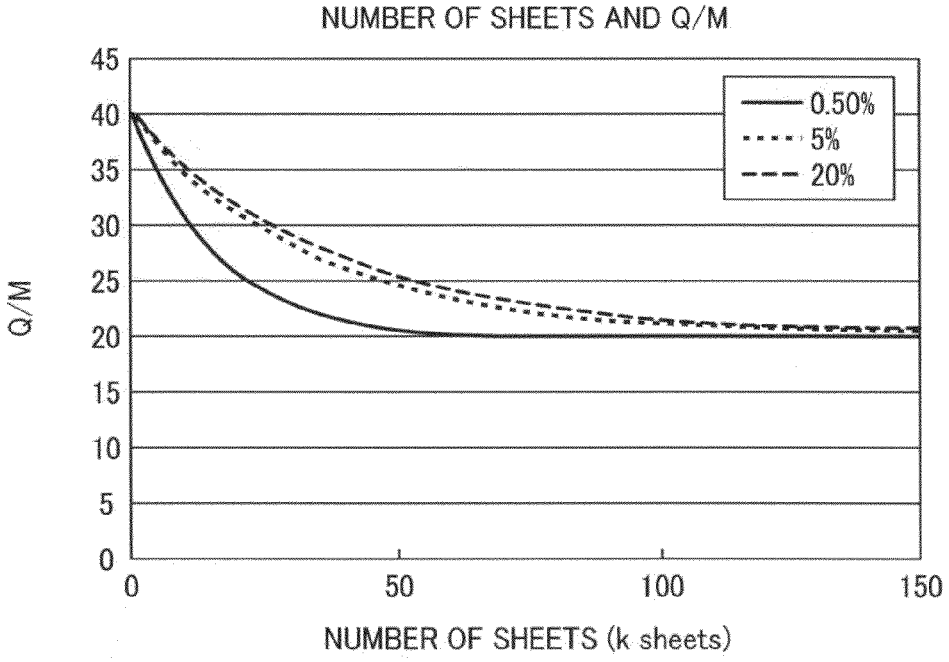
FIG. 18 is a graph showing relations between a number of sheets (number of printed sheets) on which an image is formed and the charge amount of toner (Q/M)

FIG. 18 is a graph showing relations between a number of sheets on which an image is formed (number of printed sheets) and the charge amount of toner (Q/M). In FIG. 18, changes in the charge amount of toner (Q/M) when continuously forming images having different image area ratios, i.e., 0.5%, 5%, and 20% are shown. As shown in FIG. 18, the lower is the image area ratio of the image, the more sharply the charge amount of toner decreases. This is because the lower is the image area ratio, the less is the amount of consumption of toner in the development unit 7. Consequently, a relatively large amount of toner is present in the development unit 7, thereby increasing stress on the toner.

Figure 19:
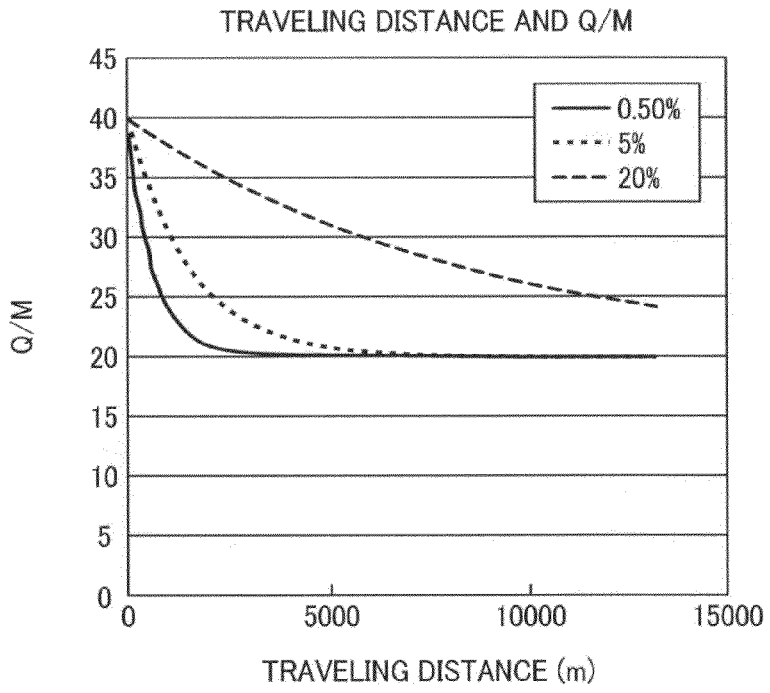
FIG. 19 is a graph showing relations between a traveling distance of a developing agent and the charge amount of toner (Q/M)

FIG. 19 is a graph showing relations between a traveling distance of the developing agent and the charge amount of toner (Q/M). More specifically, FIG. 19 shows changes in the charge amount of toner (Q/M) when continuously forming images having different image area ratios, i.e., 0.5%, 5%, and 20%. As shown in FIG. 19, not only with the low image area ratio (0.5%), but also with the high image area ratio (20%), the charge amount of toner decreases sharply. It is to be noted that the traveling distance of the developing agent may employ an estimated value obtained by a process linear velocity (photosensitive drum linear velocity) multiplied by an operating time of the development unit 7.

As understood from FIGS. 18 and 19, if the primary transfer current is adjusted in accordance with the charge amount of toner based on estimation of changes in the charge amount of toner obtained simply from the number of sheets on which an image is formed (number of printed sheets) or the traveling distance of the developing agent, there may be a significant error in the estimated value of the charge amount of toner depending on image forming operation conditions (e.g., the difference in the image area ratio), hindering appropriate adjustment of the primary transfer current. For this reason, preferably, the degree of deterioration of the developing agent takes into consideration of not only the number of sheets subjected to image formation (number of printed sheets) and the traveling distance of the development agent, but also image forming operation conditions (for example, the difference in the image area ratio).

According to the second illustrative embodiment, the degree of deterioration of the developing agent is obtained using the following equation, for example.

DEGREE OF DETERIORATION OF DEVELOPING AGENT=(TRAVELING DISTANCE OF DEVELOPING AGENT)$^2$/(AMOUNT OF TONER CONSUMPTION) [EQUATION 3]

Figure 20:
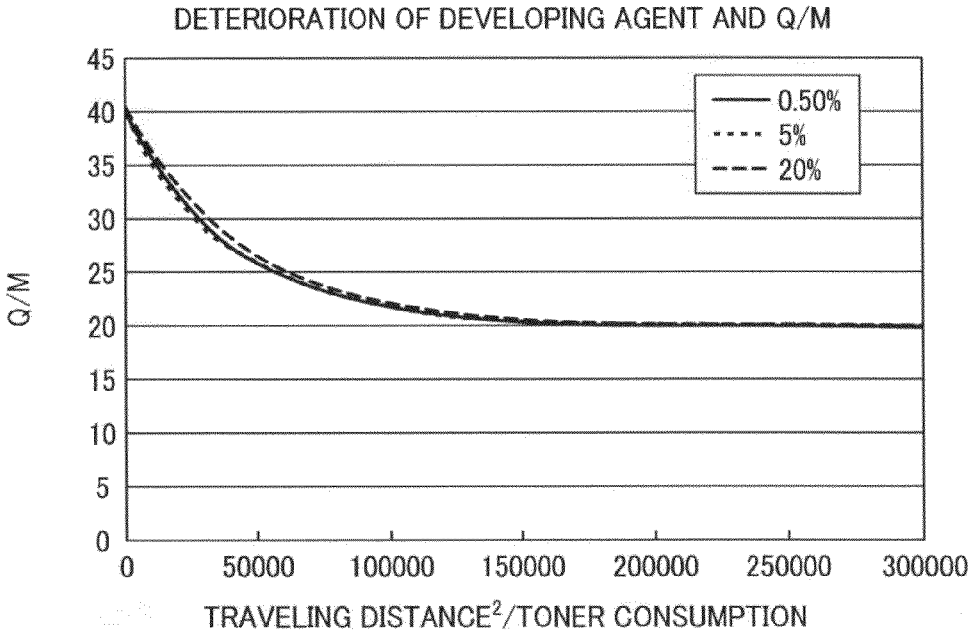
FIG. 20 is a graph showing relations between the degree of deterioration of the developing agent and the charge amount of toner (Q/M) according to an illustrative embodiment of the present disclosure.

FIG. 20 is a graph showing relations between the degree of deterioration of the developing agent and the charge amount of toner (Q/M) according to an illustrative embodiment of the present disclosure.

As understood from FIG. 20, irrespective of the print condition (i.e., image area ratio), the charge amount of toner (Q/M) decreases at a certain rate. More specifically, FIG. 20 shows changes in the charge amount of toner (Q/M) when continuously forming images having different image area ratios, i.e., 0.5%, 5%, and 20%. As shown in FIG. 20, the charge amount of toner (Q/M) in any of the image area ratios decreases in a similar manner. Therefore, using the degree of deterioration of the developing agent obtained in Equation 3, even when the image forming operation conditions differ, for example, the image area ratio differs, the degree of deterioration of the developing agent which reflects properly the change in the charge amount of toner can be obtained. Thus, the primary transfer can be adjusted or corrected in accordance with the degree of deterioration of the developing agent thus obtained. With this configuration, the primary transfer current is adjusted or corrected properly irrespective of image forming operation conditions.

The set value for the primary transfer current in the second illustrative embodiment is calculated using Equation 4.

SET VALUE=REFERENCE ELECTRIC CURRENT VALUE×ENVIRONMENT CORRECTION COEFFICIENT×ELAPSED TIME CORRECTION COEFFICIENT [EQUATION 4]

The reference electric current value herein refers to a reference primary transfer current value determined by a type, thickness, and so forth of recording medium.

The environment correction coefficient is a correction coefficient due to changes in ambient conditions including, but not limited to temperature and humidity. According to the present illustrative embodiment, in order to obtain ambient condition information, a temperature-humidity detector CHS-CSC-18 manufactured by TDK Corporation is used as an environment information obtaining device 90 (shown in FIG. 1). The temperature information is obtained from an output of a thermistor in the temperature-humidity detector while obtaining humidity information from an output of a humidity detector in the temperature-humidity detector.

Temperature and humidity are detected every minute after the power is turned on. The environment adjustment relative to the reference electric current value is performed in the same timing or on the same detection period as the temperature-humidity detection. It is to be noted that allocation of the environment information obtaining device 90 is not particularly limited. Preferably, however, the environment information obtaining device 90 is disposed spaced apart from a heat source such as the fixing device 60.

The elapsed time correction coefficient is a correction amount obtained in accordance with the degree of deterioration of the developing agent obtained by Equation 3.

Figure 21:
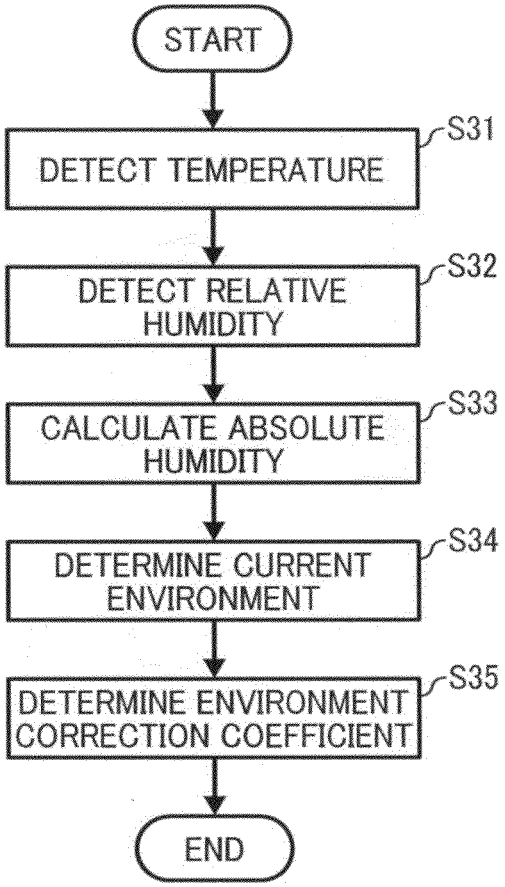
FIG. 21 is a flowchart showing steps in a process of determination of an environmental correction amount (environment correction coefficient) according to an illustrative embodiment of the present disclosure.

FIG. 21 is a flowchart showing steps in a process of determination of the amount of environment correction amount (environment correction coefficient) according to the second illustrative embodiment of the present disclosure.

In FIG. 21, at step S31, an output of the thermistor in the temperature-humidity detector is detected, and a temperature is determined using a temperature conversion table in which the thermistor output is converted to a temperature based on the correlation between the output of the thermistor and the temperature. Next, at step S32, an output of the humidity thermistor in the temperature-humidity detector is detected, and a relative humidity is determined using the temperature obtained above and a relative humidity conversion table in which the humidity detector output is converted to a relative humidity. It is to be noted that in this table, the temperature is in the row and the humidity is in the column, and the relative humidity is obtained.

Subsequently, at step S33, based on the relative humidity thus obtained and an absolute humidity conversion table, an absolute humidity is calculated. In this table, the relative humidity is in the row and the temperature is in the column, and the absolute humidity is obtained. The absolute humidity can be calculated from the temperature and the relative humidity.

Subsequently, at step S34, based on the absolute humidity thus obtained and an environment conversion table in which the absolute humidity is converted to a present environment, the present environment is determined. More specifically, in determining the present environment, to which of the following preset environment groups the present environment belongs is determined: for example, L/L (19° C., 30%), M/L (23° C., 30%), M/M (23° C., 50%), M/H (23° C., 80%), H/H (27° C., 80%), and so forth. The combination of the temperature and the humidity in the preset environment groups are not limited to the above.

Lastly, at step S35, the environment correction coefficient (i.e., the environment correction amount) corresponding to the present environment thus obtained is determined. Detection by the temperature-humidity detector does not require mechanical operations, thus allowing monitoring at all times and allowing serial control relative to changes in the ambient conditions.

Figure 22:
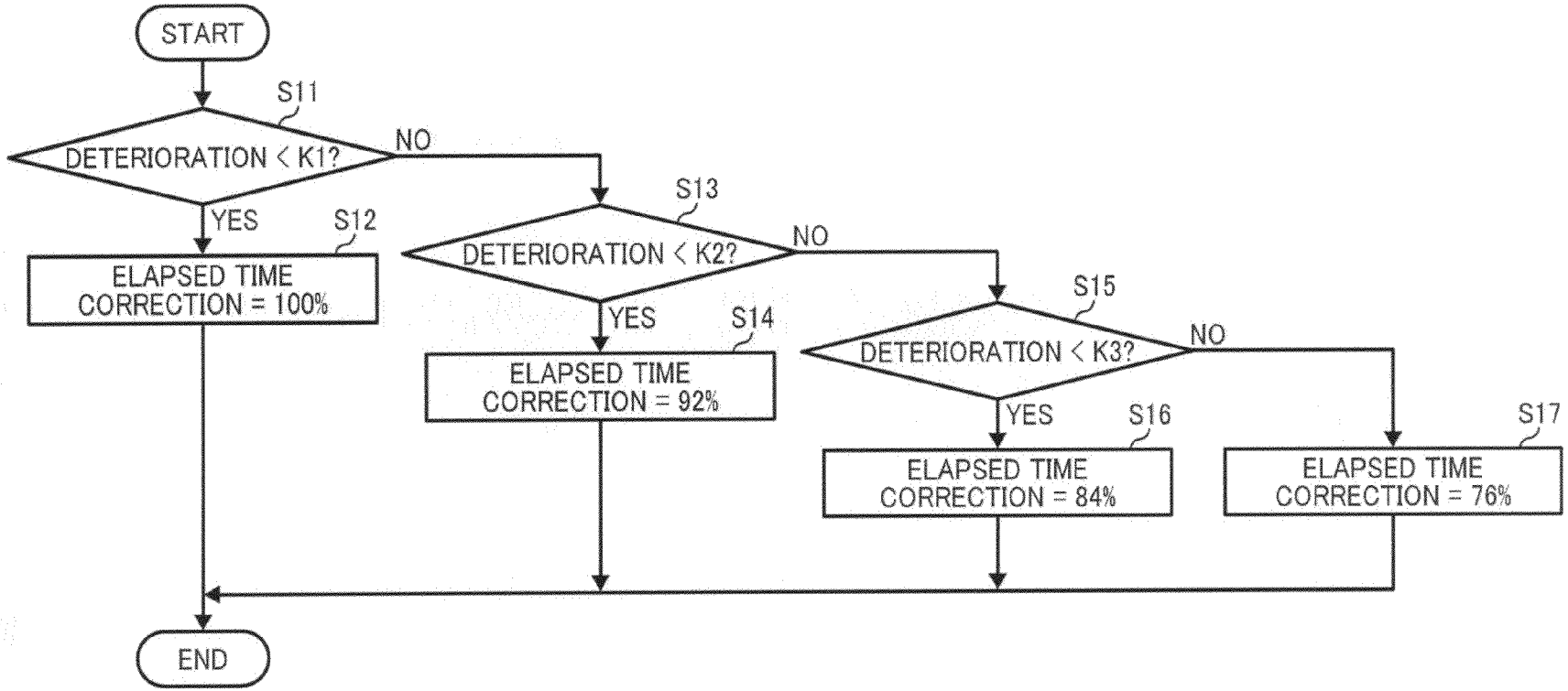
FIG. 22 is a flowchart showing steps in a process of determination of an elapsed time correction amount (elapsed time correction coefficient) according to an illustrative embodiment of the present disclosure.

FIG. 22 is a flowchart showing steps in a process of determination of the elapsed time correction amount (elapsed time correction coefficient) according to the second illustrative embodiment of the present disclosure.

In the present illustrative embodiment, the elapsed time correction amount is obtained in accordance with the degree of deterioration of the developing agent obtained by Equation 3. The rate of decrease in the charge amount of toner indicated by the degree of deterioration of the developing agent depends on various factors that decrease the charge amount of toner constituting the toner image on the intermediate transfer belt 41 with time, in addition to deterioration of developing agent and degradation of devices for charging the developing agent. However, the rate of decrease in the charge amount of toner is attributed mainly to mixing of toner in the development unit 7. That is, the main factor is a traveling distance of the developing agent which can be estimated by the process linear velocity and an operating time of the development unit 7.

Another example of a factor that affects the rate of decrease in the charge amount of toner is an amount of toner consumption in the development unit 7. The less is the consumption of toner, the longer the toner stays in the development unit 7. Consequently, the toner is subjected to repeated contact and friction with the development roller, the photosensitive drum, and so forth, so that deterioration of toner progresses. The controller 200 calculates the consumption of toner based on the image area ratio of the toner images which have been formed.

In the present illustrative embodiment, an index value indicating the degree of deterioration of the developing agent (rate of decrease in the charge amount of toner) is obtained using in Equation 3 values of the traveling distance of the developing agent and the consumption of toner that affect the rate of decrease in the charge amount of toner.

According to the present illustrative embodiment, the degree of deterioration of the developing agent thus obtained is compared with predetermined threshold values K1, K2, and K3, and the elapsed time correction coefficient (elapsed time correction amount) is determined. The amount of consumption of toner employed in the calculation of the degree of deterioration of the developing agent corresponds to an amount consumption of toner used up to the previous image formation. It is to be noted that the value of the amount of consumption of toner is reset upon replacement of the process cartridge constituting the respective image forming unit.

More specifically, as illustrated in FIG. 22, at step S11, whether or not the degree of deterioration of the developing agent is less than the threshold value K1 is determined. If the degree of deterioration is less than the threshold value K1 (YES, S11), the elapsed time correction coefficient is determined as 100% at step S12. When the degree of deterioration is equal to or greater than the threshold value K1 (NO, S11), whether the degree of deterioration of the developing agent is less than the threshold value K2 is determined at step S13. When the degree of deterioration is determined to be less than the threshold value K2 at step S13 (YES, S13), the elapsed time correction coefficient is determined as 92% at step S14. When the degree of deterioration is equal to or greater than the threshold value K2 (NO, S13), whether the degree of deterioration of the developing agent is less than the threshold K2 is determined at step S13. When the degree of deterioration is determined to be less than the threshold value K3 at step S15 (YES, S15), the elapsed time correction coefficient is determined as 84% at step S16. When the degree of deterioration is determined to be equal to or greater than the threshold value K3 at step S15 (NO, S15), the elapsed time correction coefficient is determined as 76% at step S16.

According to the second illustrative embodiment, as the threshold values, K1=10000, K2=30000, and K3=70000 are employed. However, the threshold values are not limited thereto. Using three threshold values, the degree of deterioration of the developing agent is divided into four groups, for example. The number of groups is not limited to four. Alternatively, the degree of deterioration may be divided into more groups or fewer groups. The elapsed time adjustment or correction may be performed for each print job, or upon reaching a predetermined number of sheets on which an image is formed, or for every image formation on a sheet of recording medium.

Next, a description is now provided of toner usable in the second illustrative embodiment.

In order to obtain desirable charge on toner through charging in the development unit and through charging-up in the transfer portion, it has been assumed that using the toner having a volume resistivity greater than 10.7 log Ωcm is preferable. However, in recent years, there is toner having the volume resistivity of 10.7 log Ωcm or less for reliable fixability, in particular, at low temperature. Thus, there is demand for an image forming apparatus capable of providing good image quality using such toner.

The toner having a relatively low volume resistivity has a characteristic in that this type of toner is difficult to keep the charge. It is assumed that an apparent electrostatic capacity decreases when electrical resistance decreases. Consequently, after the developing agent deteriorated with time, the charge amount of toner having a low volume resistivity drops easily as compared with toner having a high volume resistivity. Due to the decrease in the charge amount of toner with time, as described above, the optimum primary transfer current of an image having, in particular, a high image area ratio (such as an all-solid single color image) in the initial state and the optimum primary transfer current after an elapse of time separate from one another. As a result, the toner is overcharged with time, lowering the image density. In view of the above, according to the present illustrative embodiment, the primary transfer current is reduced by using the above-described elapsed time correction coefficient (elapsed time correction amount).

The volume resistivity of toner used in the second illustrative embodiment varies between colors. More specifically, because color material (pigment) in toner is different for each of the colors yellow, cyan, magenta, and black, the volume resistivity of toners differs depending on the color when using four different colors of toners such as in the image forming apparatus of the second illustrative embodiment. In particular, because the black toner is colored with carbon, the volume resistivity of the black toner easily becomes low as compared with other toners of the colors (hereinafter referred to as color toner) yellow, magenta, and cyan. More specifically, in a case in which carbon black is used as a coloring agent for the black toner, the volume resistivity of the toner is approximately 10.7 log Ωcm.

Specific examples of the coloring agent for the toner of the colors yellow, cyan, and magenta include, but are not limited to, aniline blue, phthalocyanine blue, phthalocyanine green, hansa yellow G, rhodamine 6g Lake, calco oil blue, chrome yellow, quinacridone, benzidine yellow, rose bengal, and triarylmethane. These materials can be used alone or in combination, and the volume resistivity of the toner is approximately 10.9 log Ωcm.

In this case, as compared with the color toner, the charge amount of the black toner drops easily in accordance with the degree of deterioration of the developing agent. Thus, it is difficult to adjust imaging quality for both the black toner and the color toners if the same elapsed time adjustment is performed on the primary transfer current for the black toner and on the primary transfer current for the color toner. In view of the above, according to the second illustrative embodiment, a different elapsed time correction amount is applied to the primary transfer current for the color black and to the primary transfer current for the color toner.

More specifically, for example, the elapsed time correction is performed only on the primary transfer current for the developing agent for the black toner, the degree of deterioration of which progresses faster with time than the developing agent for the color toner. No elapsed time correction is performed on the primary transfer current for the color toner. In this case, the elapsed time correction coefficient is determined only for the black toner in accordance with the procedure shown in FIG. 22, while the elapsed time correction coefficient of the primary transfer current for the color toner is always 100%. This means that the elapsed time correction amount of the primary transfer current for the color toner is zero.

Figure 23:
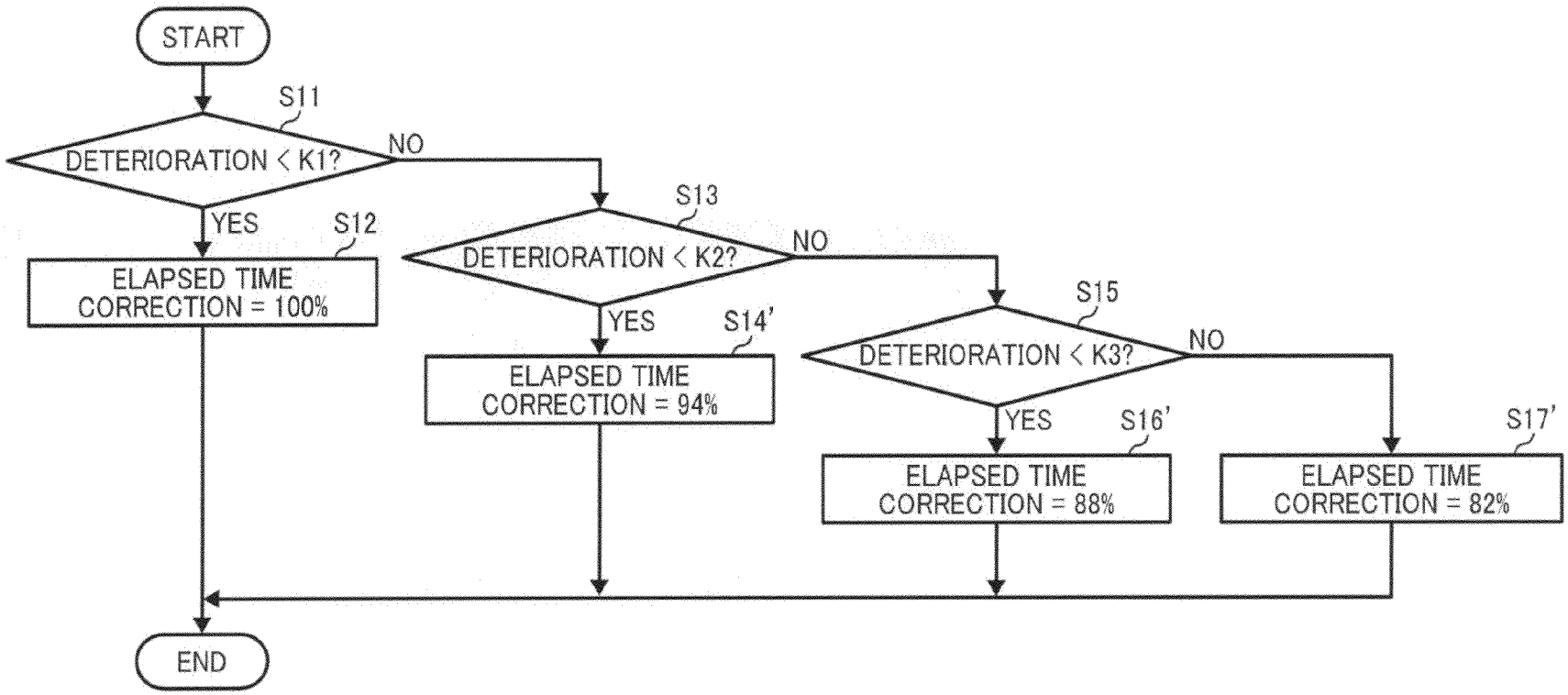
FIG. 23 is a flowchart showing another example of steps in a process of determination of the elapsed time correction amount (elapsed time correction coefficient) according to an illustrative embodiment of the present disclosure.

Alternatively, the elapsed time correction coefficient to be determined for the black toner may be less than that of the color toner. That is, the correction amount of the primary transfer current for the color black is greater than that of the color toner. For example, the elapsed time correction coefficient is determined only for the black toner in accordance with the procedure shown in FIG. 22, and the elapsed time correction coefficient for the color toner is determined in accordance with the procedure shown in FIG. 23.

Figure 24:
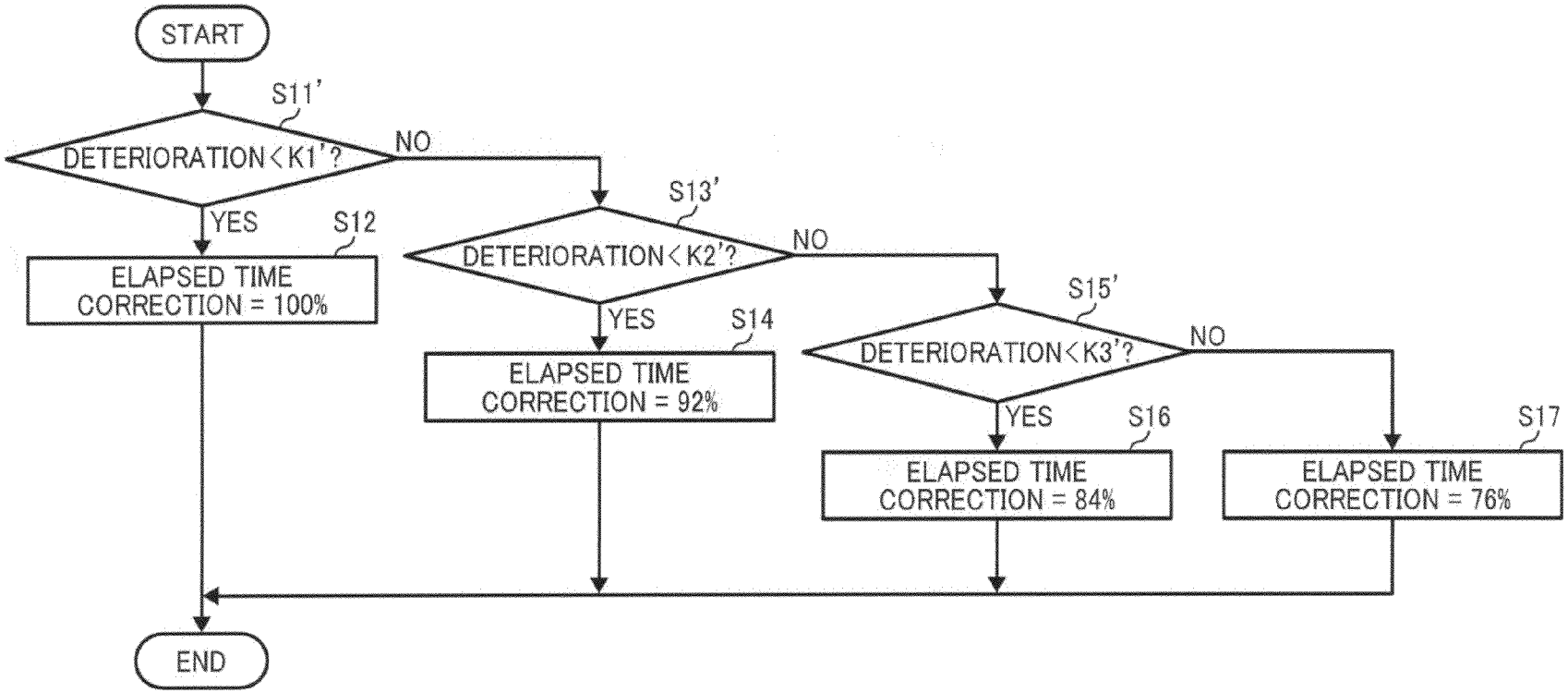
FIG. 24 is a flowchart showing another example of steps in a process of determination of the elapsed time correction amount (elapsed time correction coefficient) according to an illustrative embodiment of the present disclosure.

Alternatively, the threshold values K1, K2, and K3 for changing the elapsed time correction coefficient for the black toner may be less than threshold values K1', K2', and K3' for the color toner. In this case, the correction amount of the primary transfer current for the color black is also greater than that of the color toner. For example, the elapsed time correction coefficient is determined only for the black toner in accordance with the procedure shown in FIG. 22, and the elapsed time correction coefficient for the color toner is determined in accordance with the procedure shown in FIG. 24. It is to be noted that the relations of the threshold values for the black toner and the color toner satisfy the following: $K1<K1'$, $K2<K2'$, $K3<K3'$.

As mentioned above, the charge amount of black toner having a low volume resistivity (in particular, 10.7 log Ωcm or less) drops easily in accordance with the degree of deterioration of the developing agent as compared with the color toner. According to the present illustrative embodiment, the elapsed time correction amount for the black toner is greater than that for the color toner. In other words, the elapsed time correction coefficient for the black toner is less than that for the color toner. With this configuration, appropriate adjustment or correction is performed on the primary transfer current in accordance with the rate of decrease in the charge amount of the respective toners having different volume resistivity values.

The volume resistivity of the above described toner is obtained by forming toner powder of 3 g into a pellet having a thickness of approximately 3 mm by an electric pressing machine and measuring the volume resistivity of the pellet thus obtained by a TR-10C type dielectric loss measuring instrument (manufactured by Ando Electric Co., Ltd.), for example.

[Variation 1]

A description is provided of a first variation (Variation 1) of the second illustrative embodiment. In the variation 1, as the degree of deterioration of the developing agent, a detection result of an image density of a test pattern formed during the image quality adjustment control (also known as process control) for adjustment of image quality is used instead of using the degree of deterioration of the developing agent obtained in Equation 3 (i.e., TRAVELING DISTANCE OF THE DEVELOPING AGENT$^2$/AMOUNT OF TONER CONSUMPTION).

First, a description is provided of the image quality adjustment control (process control) according to the variation 1.

In the image quality adjustment control, a test pattern is formed and detected so as to adjust an image density and alignment of an image. The image quality adjustment control includes an image density control and an alignment adjustment control. In the image density control, for example, a test pattern for density adjustment (i.e., image quality adjustment) is formed by developing a predetermined pattern latent image. A toner adhesion amount, that is, an image density of the test pattern is detected, and based on the detection result, various settings such as the toner density in the developing agent in the development unit, writing conditions such as exposure power of the optical writing unit 20, a charging bias, and a development bias are adjusted.

In the alignment adjustment control, for example, a test pattern for image alignment adjustment (i.e., image quality adjustment) is detected and based on the detection result, writing timing at which a latent image of each of the toner images is written is adjusted.

The test pattern for the image quality adjustment, i.e., the test pattern for density adjustment, is detected, for example, on the photosensitive drum between the development area and a primary transfer portion, or on the intermediate transfer belt after primary transfer. However, in a case in which the diameter of the photosensitive drum is relatively small, it is difficult to detect the test pattern on the photosensitive drum because of installation space for the detector. Therefore, preferably, the test pattern is detected on the intermediate transfer belt.

The test pattern for the alignment adjustment needs to be detected on the intermediate transfer belt because it is necessary to detect misalignment of toner images caused by the difference in the distance between the photosensitive drums and different writing timing of the latent images of each color. In the present illustrative embodiment, both the test pattern for density adjustment and the test pattern for image alignment adjustment are detected on the intermediate transfer belt.

In general, the image quality adjustment control (process control) is performed when the power is turned on, before and after print job, and during a non-image formation period during which no image forming operation is performed such as after image forming operation on a predetermined number of sheets. For further stability of the image quality, the test pattern for image quality adjustment may be formed in a non-image area between successive image areas during image forming operation and detected. An image area refers to an image portion on a recording medium onto which an image is transferred. The image quality adjustment control during such image forming operation is carried out mostly when controlling a reference value (target toner density) of the toner density control of the toner density detector.

In the present illustrative embodiment, the test pattern for image quality adjustment is formed for each color and consists of two patterns: a horizontal band pattern with a long length in the main scanning direction and a patch pattern with a short length in the main scanning direction. An image density (toner adhesion amount) ID of both the horizontal pattern and the patch pattern is detected for each color by a detector, and an image density difference ΔID between the image density of the horizontal pattern and the image density of the patch pattern is calculated. The value thus obtained is used as the degree of deterioration of the developing agent. As will be described below, the greater is the image density difference ΔID, the greater is the rate of decrease in the charge amount of toner.

More specifically, when performing the primary transfer using an optimum primary transfer current (initial optimum value) in the initial state in which the developing agent has not deteriorated, the primary transfer rate of the patch pattern and the primary transfer rate of the solid image are substantially the same, that is, both approximately 97% in the initial state. By contrast, after an elapse of time in which the developing agent deteriorated, the primary transfer rate of the patch pattern is approximately 94% while the primary transfer rate of the solid image is approximately 84%. There is a significant difference in the primary transfer rate between the patch pattern and the solid image. This indicates that there is a correlation between the charge amount of toner and the primary transfer rate in that as deterioration of the developing agent progresses, causing the charge amount of toner to decrease, the difference in the primary transfer rate between the patch pattern image and the solid image increases.

Based on this correlation, it is understood that when the difference ΔID of the image density between the horizontal band pattern and the patch pattern on the intermediate transfer belt obtained from the image density detection result is large, the degree of deterioration of the developing agent (the rate of decrease in the charge amount of toner) is large.

In the present illustrative embodiment, the horizontal band pattern is a 20 mm (vertical)×300 mm, all-solid single color image with a maximum image density. The patch pattern for each color is a 20 mm (vertical)×10 mm, all-solid single color image with a maximum image density. The image density (toner adhesion amount) of these patterns is detected on the intermediate transfer belt 41 by the detector (optical detector). It is to be noted that the test pattern for image quality adjustment to calculate the degree of deterioration of the developing agent is not limited to the patterns described above.

Figure 25:
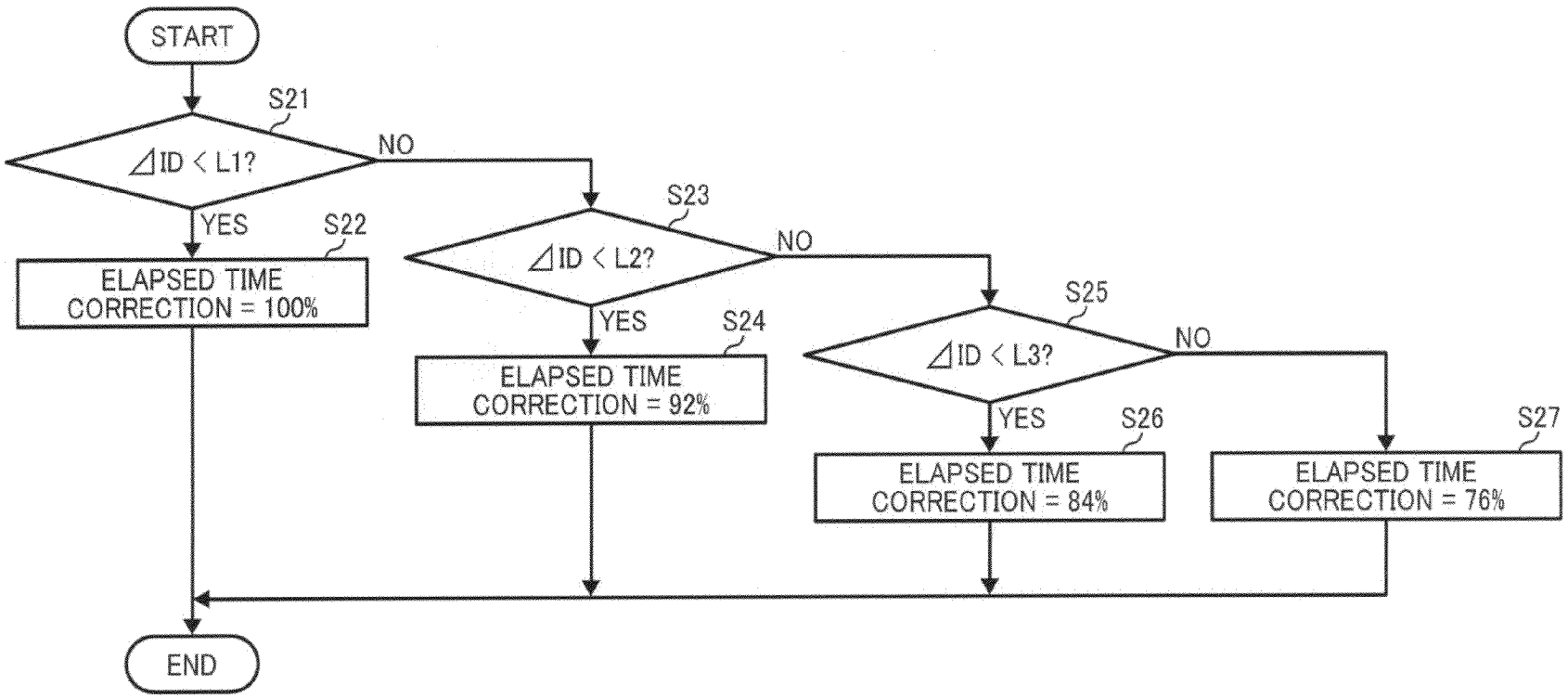
FIG. 25 is a flowchart showing steps in a process of determination of the elapsed time correction amount (elapsed time correction coefficient) according to a variation 1 of the second illustrative embodiment.

FIG. 25 is a flowchart showing example steps in a process of determination of the elapsed time correction amount (elapsed time correction coefficient) according to the variation 1.

According to the present illustrative embodiment, the elapsed time correction amount is obtained using the difference ΔID of the image density between the horizontal band pattern and the patch pattern as described above. More specifically, as illustrated in FIG. 25, at step S21, whether or not the difference ΔID is less than a threshold value L1 is determined. If the difference ΔID is less than the threshold value L1 (YES, S21), the elapsed time correction coefficient is determined as 100% at step S22. When the difference ΔID is equal to or greater than the threshold value L1 (NO, S21), whether the difference ΔID is less than a threshold value L2 is determined at step S23. When the difference ΔID is determined to be less than the threshold value L2 at step S23 (YES, S23), the elapsed time correction coefficient is determined as 92% at step S24. When the difference ΔID is equal to or greater than the threshold value L2 (NO, S23), whether the difference ΔID is less than a threshold value L3 is determined at step S25. When the difference ΔID is determined to be less than the threshold value L3 at step S25 (YES, S25), the elapsed time correction coefficient is determined as 84% at step S26. When the difference ΔID is determined to be equal to or greater than the threshold value L3 at step S25 (NO, S25), the elapsed time correction coefficient is determined as 76% at step S27.

According to the present illustrative embodiment, as the threshold values, L1=0.08, L2=0.14, and L3=0.20 are employed. However, the threshold values are not limited thereto. Using three threshold values, the difference ΔID is divided into four groups, for example. The number of groups is not limited to four. Alternatively, the difference ΔID may be divided into more groups or fewer groups.

In the variation 1 of the second illustrative embodiment, as compared with the color toner, the charge amount of the black toner drops easily in accordance with the degree of deterioration of the developing agent. Thus, a different elapsed time correction amount is applied to the primary transfer current for the color black and to the primary transfer current for the color toner. More specifically, similar to the second illustrative embodiment, for example, the elapsed time correction is performed only on the primary transfer current for the developing agent for the black toner, the deterioration of which progresses faster with time than the developing agent for the color toner. No elapsed time correction may be performed on the primary transfer current for the color toner.

In another alternative, the elapsed time correction coefficient to be determined for the black toner may be less than that of the color toner. In still another alternative, the threshold values L1, L2, and L3 for changing the elapsed time correction coefficient for the black toner may be less than threshold values L1', L2', and L3' for the color toner.

[Variation 2]

A description is provided of a second variation of the second illustrative embodiment (hereinafter referred to as variation 2).

The image forming apparatus (for example, a printer) according to the second illustrative embodiment forms an image with at least one color arbitrarily selected. To simplify a description, a description is provided of an example of two different modes: a black single color mode (second control mode) and a full-color mode (first control mode). In the black single color mode, only the toner image formed on the photosensitive drum 3K of the color black disposed at the extreme downstream end in the moving direction of the intermediate transfer belt 41 is transferred primarily onto the intermediate transfer belt 41, and then transferred secondarily onto a recording medium P, thereby forming a single color image (monochrome image) of the color black. By contrast, in the full-color mode, the toner images formed on all of the photosensitive drums 3M, 3C, 3Y, and 3K are transferred primarily onto the intermediate transfer belt 41 such that they are superimposed one atop the other, forming a four-color composite toner image. The four-color composite toner image is secondarily transferred onto a recording medium P, thereby forming a full color image on the recording medium.

In the variation 2, the primary transfer bias in the image forming unit 1K for the color black disposed at the extreme downstream end in the moving direction of the intermediate transfer belt 41 is reduced in steps in the black single color mode. In the full-color mode, by contrast, the primary transfer bias is increased in steps.

As described above, in the event in which the charge amount of overall toner has dropped due to deterioration of the developing agent with time, the set value of the primary transfer current is reduced to prevent degradation of the primary transfer rate. In either the black single color mode or the full-color mode, preferably, the primary transfer bias for the color black is reduced in stages in terms of the primary transfer rate. However, the image density of the color black in an output image depends on the primary transfer rate so that it is necessary to take both the primary transfer rate and the secondary transfer rate into consideration with balance.

Thus, in the full-color mode, multiple toner images are transferred onto the intermediate transfer belt 41 such that they are superimposed one atop the other, forming a composite toner image. The composite toner image thus obtained needs to be transferred secondarily from the intermediate transfer belt 41 onto a recording medium P. By contrast, in the black single color mode in which only one of the image bearing members (hereinafter referred to as downstream image bearing member) used in the full-color mode is used, one toner image (black color) without other toner images superimposed thereon is transferred secondarily from the intermediate transfer belt 41 to the recording medium P. As a result, an amount of toner to be transferred secondarily to the recording medium P at the secondary transfer portion is greater in the full-color mode than in the black single color mode. Therefore, an optimum secondary transfer bias to achieve an optimum secondary transfer rate is greater in the full-color mode than in the black single color mode. Thus, the secondary transfer bias is set greater in the full-color mode than in the black single color mode.

At this time, if the primary transfer current is reduced in accordance with the degree of deterioration of the developing agent, the primary transfer rate is enhanced. However, since the charge amount of overall toner is relatively low due to deterioration of the developing agent and hence the primary transfer current gets low, the charge amount of toner at the secondary transfer portion is even lower than before adjustment or correction. Degradation of image quality attributed to the decrease in the charge amount of toner at the secondary transfer portion is greater in the full-color mode in which the secondary transfer bias is relatively high than in the black single color mode in which the secondary transfer bias is relatively low.

The relations between the secondary transfer current and the secondary transfer rate may be considered as having substantially the same relations as between the primary transfer current and the primary transfer rate. That is, during which the amount of toner moving from the photosensitive drum side to the intermediate transfer belt side at the secondary transfer portion increases with an increase in the secondary transfer bias, flow of electric current caused by the movement of toner increases, hence increasing the secondary transfer current. By contrast, after the amount of movement of toner reaches a state of saturation, the flow of electric current caused by the movement of toner stops increasing. Consequently, the electrical discharge at the secondary transfer portion increases in accordance with an increase in the secondary transfer bias. In this case, the secondary transfer current increases with an increase in the electrical discharge. However, the secondary transfer rate decreases with the increase in the electrical discharge.

The value of the secondary transfer current in the full-color mode is set to achieve a highest possible secondary transfer rate within a range in which the secondary transfer rates for each of the plurality of toner images constituting the composite toner image are approximately the same (that is, none of the secondary transfer rates has a significant low value relative to all the other ratios). The toner image to be transferred primarily from the photosensitive drum disposed in the upstream side in the surface moving direction of the intermediate transfer belt among the plurality of toner images constituting the composite toner image is charged up with the primary transfer current when passing through the primary transfer portion in the downstream therefrom. As a result, the charge amount of toner in the secondary transfer portion is higher than that of the toner image to be transferred primarily from the downstream photosensitive drum.

In a case in which the secondary transfer current for transferring secondarily the plurality of toner images having different charge amounts all at once is determined as described above, for the toner image with a relatively low charge amount (the toner image transferred primarily from the downstream photosensitive drum), the secondary transfer current is set to a higher value than a value (peak value) achieving the maximum secondary transfer rate.

That is, in the full-color mode, the secondary transfer current for the black toner image in the downstream is set to a higher value than a value (peak value) achieving the maximum secondary transfer rate.

By contrast, in the black single color mode for forming only the black toner image, because there is one toner image to be formed, that is, the black toner image, the secondary transfer current is set to achieve the optimum secondary transfer rate for the black toner image.

In a case in which the primary transfer current for the image forming unit 1K disposed at the extreme downstream end is reduced in accordance with the degree of deterioration of the developing unit in the full-color mode and the black single color mode, with the decrease in the primary transfer current for the black toner image the charge amount of toner at the secondary transfer portion becomes lower than that before the adjustment. At this time, as the charge amount of toner in the secondary transfer portion decreases, the flow of electric current caused by the movement of the toner at the secondary transfer portion decreases. Thus, when the amount of movement of toner reaches the state of saturation the secondary transfer current (i.e., when the secondary transfer rate reaches its peak) is less than that before the adjustment. As a result, the relations between the secondary transfer current and the secondary transfer rate after adjustment or correction of the primary transfer current shift towards the lower secondary transfer current side.

The rate of change in the secondary transfer rate relative to the change in secondary transfer current tends to increase when the secondary current separates from the peak value for achieving the maxim secondary transfer rate. That is, in the full-color mode, the set value of the secondary transfer current in the full-color mode before adjustment is shifted towards the higher secondary transfer current than the peak value for achieving the maximum secondary transfer rate. As a result, when the peak value shifts toward the lower secondary transfer current side due to adjustment of the primary transfer current, the set value of the secondary transfer current separates further away from the peak value for achieving the maximum secondary transfer rate. As a result, in the full-color mode, the adjustment of the primary transfer current for the color black results in a significant decrease in the secondary transfer rate.

By contrast, as described above, in the black single color mode, the set value of the secondary transfer current for the black toner image before the adjustment is set to be near the peak value for achieving the maximum secondary transfer rate for the color black. With this configuration, even when the peak value shifts toward the lower secondary transfer current side after the adjustment of the primary transfer current, the set value of the secondary transfer current does not separate from the peak value for achieving the maximum secondary transfer rate. Thus, the decrease in the secondary transfer rate for the color black due to the adjustment of the primary transfer current for the color black is less than the full-color mode.

In the second illustrative embodiment, in the black single color mode, the primary transfer current is reduced in accordance with the degree of deterioration of the developing agent. By contrast, in the full-color mode, the primary transfer current is increased in accordance with the degree of deterioration of the developing agent. With this configuration, in the black single color mode, there is less influence of the decrease in the secondary transfer rate attributed to the adjustment of the primary transfer current on image quality, and hence the decrease in the primary transfer rate attributed to the deterioration of the developing agent is corrected by adjusting the primary transfer current. Accordingly, degradation of image quality is suppressed, if not prevented entirely.

In the full-color mode, with regards to the degradation of image quality, there is more influence of the decrease in the secondary transfer rate attributed to the adjustment of the primary transfer current in which the primary transfer current is reduced than of the decrease in the primary transfer current attributed to the deterioration of the developing agent. According to the present illustrative embodiment, in the full-color mode, the primary transfer current for the color black is increased in accordance with deterioration of the developing agent. Although the primary transfer rate for the color black may not be enhanced, the charge amount of the black toner at the secondary transfer portion is increased, thereby enhancing the secondary transfer rate for the color black. As a result, the image density of the color black is prevented from decreasing in the full-color mode.

[Variation 3]

A description is provided of a third variation of the second illustrative embodiment (hereinafter referred to as variation 3).

According to the present illustrative embodiment, in the full-color mode, the frequency of use of the black toner is reduced at a black image portion as the degree of deterioration of the developing agent increases, and use of composite black or process black made with toners of cyan, magenta, and yellow is increased instead.

As described above, in the full-color mode, when the charge amount of black toner decreases due to the deterioration of the developing agent, not only the primary transfer rate, but also the secondary transfer rate drops significantly. If the primary transfer current for black color is reduced to improve the primary transfer rate, the secondary transfer rate for black color drops significantly, thereby reducing easily the image density of the black color. Even when the charge amount of toner decreases due to deterioration of the developing agent, the toner images of yellow, cyan, and magenta to be transferred from the image forming units 1Y, 1C, and 1M disposed upstream from the image forming unit 1K of the black color in the surface moving direction of the intermediate transfer belt 41 are charged up with the primary transfer current for the color black when passing at least through the image forming unit 1K and hence an adequate amount of charge is maintained on toner at the secondary transfer portion.

As described above, in the present illustrative embodiment, the toners of yellow, cyan, and magenta have a higher volume resistivity than that of the black toner and are easily charged. Thus, the charge amount of toner thereof at the secondary transfer portion is higher than that of the black toner.

According to the present illustrative embodiment, taking advantage of these characteristics, an image of the color black is formed more frequently with the process black made with toners of cyan, magenta, and yellow having a small rate of decrease in the transfer rate even when the degree of deterioration of the developing agent is significant. With this configuration, the image density of the black color is prevented from decreasing.

[Variation 4]

A description is provided of a fourth variation of the fourth illustrative embodiment (hereinafter referred to as variation 4).

In a case in which the charge amount of black toner has decreased due to the deterioration of the developing agent, not only the primary transfer rate, but also the secondary transfer rate drops easily. In this state, reducing the secondary transfer current can enhance the secondary transfer rate. More specifically, in a case in which the primary transfer current is reduced, hence reducing further the charge amount of toner at the secondary transfer portion, the secondary transfer current is reduced in return to prevent degradation of image quality as compared with performing no adjustment on the secondary transfer current. Reducing the secondary transfer current can also prevent degradation of image quality attributed to a residual image and enhance the life of parts used for the transfer process.

[Variation 5]

A description is provided of a fifth variation of the second illustrative embodiment (hereinafter referred to as variation 5).

The set value for the primary transfer current in the present illustrative embodiment is calculated using Equation 5. In the present illustrative embodiment, the environment correction coefficient is changed in accordance with the degree of deterioration of the developing agent.

$$\text{SET VALUE} = \text{REFERENCE ELECTRIC CURRENT VALUE} \times \text{ENVIRONMENT CORRECTION COEFFICIENT} \quad \text{[EQUATION 5]}$$

An example control of the present illustrative embodiment is shown in FIG. 26. In FIG. 26, the deterioration of the developing agent is categorized into three groups in the similar or the same manner as changing the elapsed time correction coefficient of the primary transfer current.

[Variation 6]

A description is provided of a sixth variation of the second illustrative embodiment (hereinafter referred to as variation 6).

In the present illustrative embodiment, electrical resistance of a path through which the primary current flows upon primary transfer is detected by electrical resistance detectors 80Y, 80M, 80C, and 80K (shown in FIG. 1), and the elapsed time correction coefficient is determined in consideration of the electrical resistance thus obtained. The electrical resistance of transfer devices such as the primary transfer rollers 45Y, 45C, 45Y, and 45K, and the intermediate transfer belt 41 contributes largely to the primary transfer rate. More specifically, if the electrical resistance of these devices is too low, an influence of the electrical resistance of a toner layer in the primary transfer portion becomes pronounced and the primary transfer bias changes significantly depending on the image area ratio. In other words, the primary transfer rate varies depending on the image area ratio.

By contrast, in a case in which the electrical resistance of the transfer devices is too high, leakage of electrical current becomes too high, resulting in image defects and an increase in voltage near the upper limit of the power source, hence hindering flow of the electric current. When this occurs, transfer is not performed properly and the power source may be damaged.

The electrical resistance of the transfer devices such as the intermediate transfer belt 41 and the primary transfer rollers 45Y, 45C, 45Y, and 45K (the electrical resistance material on the primary transfer current path) changes often with time. In view of the above, in the present illustrative embodiment, with the change in the electrical resistance of these transfer devices, the elapsed time correction coefficient is changed, thereby adjusting properly the primary transfer current to accommodate changes in the electrical resistance of the transfer devices.

In the second illustrative embodiment, as described above, the power source which supplies the primary transfer voltage to the primary transfer rollers 45Y, 45C, 45Y, and 45K is under constant current control. Thus, by detecting the primary transfer voltage supplied to the primary transfer rollers 45Y, 45C, 45Y, and 45K, the electrical resistance of the transfer devices can be detected. It is to be noted that the voltage supplied to the primary transfer rollers 45Y, 45C, 45Y, and 45K is detected. However, detection of the voltage is not limited to the primary transfer rollers. For example, only the voltage supplied to the intermediate transfer belt 41 may be detected. Alternatively, the voltage of at least one of the primary transfer rollers 45Y, 45C, 45Y, and 45K, and the intermediate transfer belt 41 may be detected.

In the present illustrative embodiment, in a case in which an electric current used to detect the electrical resistance is, for example, approximately 25 μA, the applied voltage of the primary transfer rollers 45Y, 45C, 45Y, and 45K and the electrical resistance thereof have relations as shown in FIG. 27. As understood from FIG. 27, the primary transfer voltage differs depending on the electrical resistance of the primary transfer roller. That is, the higher is the electrical resistance, the higher is the primary transfer voltage. Therefore, the detection of the primary transfer voltage allows understanding of the resistance of the primary transfer roller.

FIG. 28 is a table showing an example of relations between the electrical resistance of the primary transfer roller and a primary transfer current (an optimum current) capable of achieving a maximum primary transfer rate.

As can be understood from FIG. 13, where the electrical resistance of the primary transfer roller as a reference is approximately ten to the power of 7.5 ($1\times10^{7.5}\Omega$) the appropriate primary transfer current is 25 μA. When the electrical resistance of the primary transfer roller is approximately ten to the power of 7.0, the appropriate primary transfer current is 29 μA. Therefore, when the electrical resistance of the primary transfer roller is changed from ten to the power of 7.5 to the power of 7.0, the set value of the primary transfer current is adjusted by an adjustment amount of +4 μA. Therefore, preferably, when the electrical resistance of the primary transfer roller is changed from ten to the power of 7.5 to the power of 8.0, the set value of the primary transfer current is adjusted by an adjustment amount of −4 μA.

When the electrical resistance of the primary transfer was ten to the power of 9.0, the set value 21 μA of the primary transfer current caused an image failure attributed to electric discharge. At this time, when the set value of the primary transfer current was 17 μA, no image failure occurred. When the set value of the primary transfer current is either 21 μA or 17 μA, there is not much difference in the transfer rate. Thus, when the electrical resistance of the primary transfer roller is ten to the power of 9.0, preferably, the set value of the transfer current is adjusted by an adjustment amount of −8 μA.

In a case in which the primary transfer current is adjusted in accordance with the electrical resistance of the primary transfer roller as described above, the amount of adjustment or correction of the elapsed time correction coefficient is selected based on whether or not the primary transfer voltage detected is lower or higher than the predetermined threshold voltage value. FIG. 29 is a table showing an example of relations between the detected primary transfer voltage and the time correction coefficient after being changed in accordance with the detected primary transfer voltage.

In the present illustrative embodiment, the primary transfer current can be adjusted or corrected in accordance with a change in the electrical resistance of the transfer devices, thereby achieving more optimum primary transfer rate than when adjusting the primary transfer current in accordance with the change in the charge amount of toner attributed to the deterioration of the developing agent.

Although advantageous, the detection of voltage as described above necessitates mechanical operations such as reading a voltage by supplying a transfer current for a certain period of time, hence reducing the productivity of the machines due to operations associated with the detection of voltage. However, the image quality adjustment control (i.e., process control) is often performed during the non-image formation period so that performing the above-described detection of voltage during the image quality adjustment control prevents degradation of the productivity of the machines due to performing the detection of voltage alone. Therefore, in the present illustrative embodiment, the voltage is detected during the image quality adjustment control.

It is to be noted that in the present illustrative embodiment, an example has been given of changes in the primary transfer roller. Alternatively, since the electrical resistance of the intermediate transfer belt 41 changes in a similar manner as that of the primary transfer roller, the primary transfer roller current may be adjusted or corrected in accordance with the electrical resistance of the intermediate transfer belt 41.

In a case in which the primary transfer bias is applied under constant voltage control, not under constant current control, the electrical resistance of the transfer devices is detected by detecting the primary transfer current.

The above descriptions have been provided of the second illustrative embodiment and the variations. Various modifications and alterations of this disclosure will become apparent to those skilled in the art without departing from the scope and principles of this disclosure, and it should be understood that this disclosure is not to be unduly limited to the illustrative embodiments set forth herein. For example, the detection of the degree of deterioration of the developing agent and the determination of whether the degree of deterioration of the developing agent has reached a level requiring the elapsed time correction adjustment of the primary transfer current are not performed on all image forming units in the image forming apparatus in view of simplification of control, but are performed only on the image forming unit in use. The primary transfer current is controlled using a voltage value, instead of a current value. The developing agent is either a single-component developing agent consisting of toner or a two-component developing agent consisting of toner and carrier. The environment detector may be provided to each image forming unit.

Figure 30:
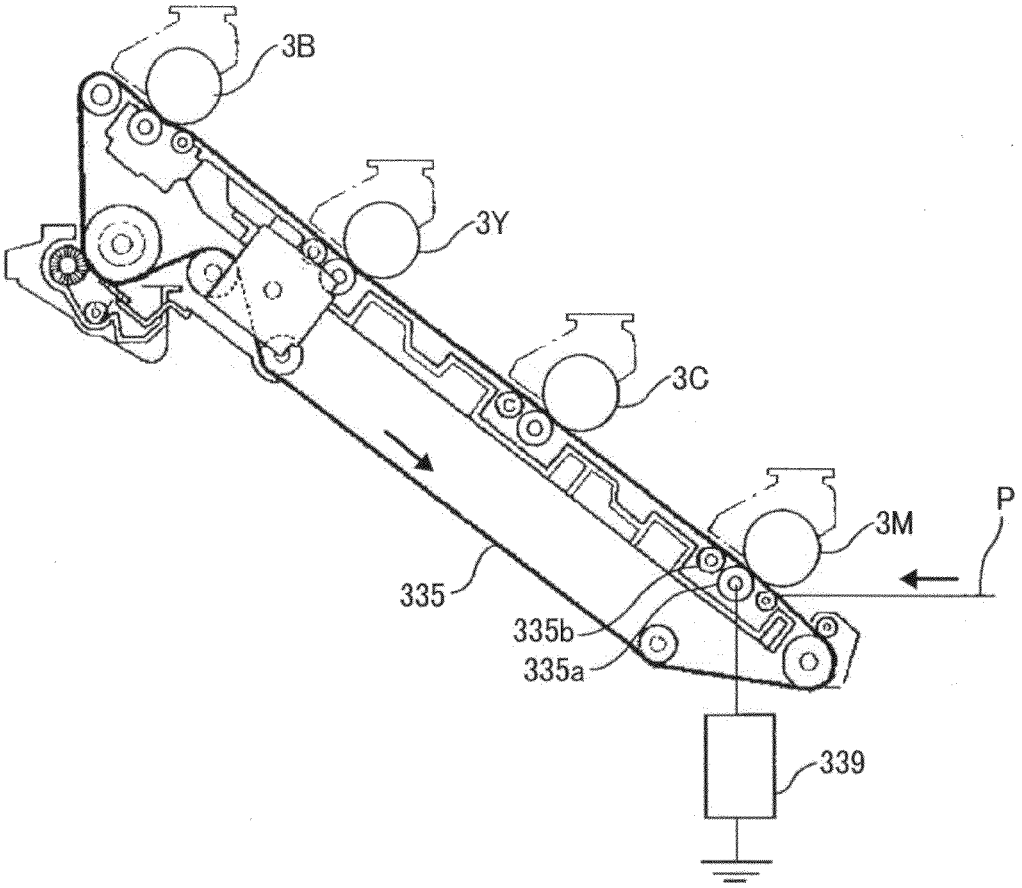
FIG. 30 is a schematic diagram illustrating an example of an image forming apparatus using a direct-transfer method according to an illustrative embodiment of the present disclosure.

According to the second illustrative embodiment, the image forming apparatus employs a so-called intermediate transfer method in which the toner image formed on the photosensitive member is transferred primarily onto the intermediate transfer belt, and then transferred onto a recording medium. Alternatively, the image forming apparatus may employ a direct transfer method in which the toner image formed on the photosensitive member is transferred directly onto a recording medium as illustrated in FIG. 30. FIG. 30 is a cross-sectional diagram schematically illustrating an image forming apparatus of the direct transfer method.

The image forming apparatus to which the variations 2 through 4 can be applied is not limited to the image forming apparatus described above. As illustrated in FIG. 30, transfer portions are formed between a transfer belt 335 and each of the four photosensitive drums 3M, 3C, 3Y, and 3K. The transfer belt 335 is formed into a loop. A bias roller 335*a* and an auxiliary roller 335*b* are disposed near or contact an inner circumferential surface of the transfer belt 335 at the transfer portions. Each of the bias rollers 335*a* is connected to a transfer bias power source 339 which applies a transfer bias to each of the bias rollers 335*a*. FIG. 30 illustrates only the transfer bias power source 339 corresponding to the photosensitive drum 3M for the color magenta, and the transfer bias power sources for other photosensitive drums are omitted herein for simplicity.

Figure 17:
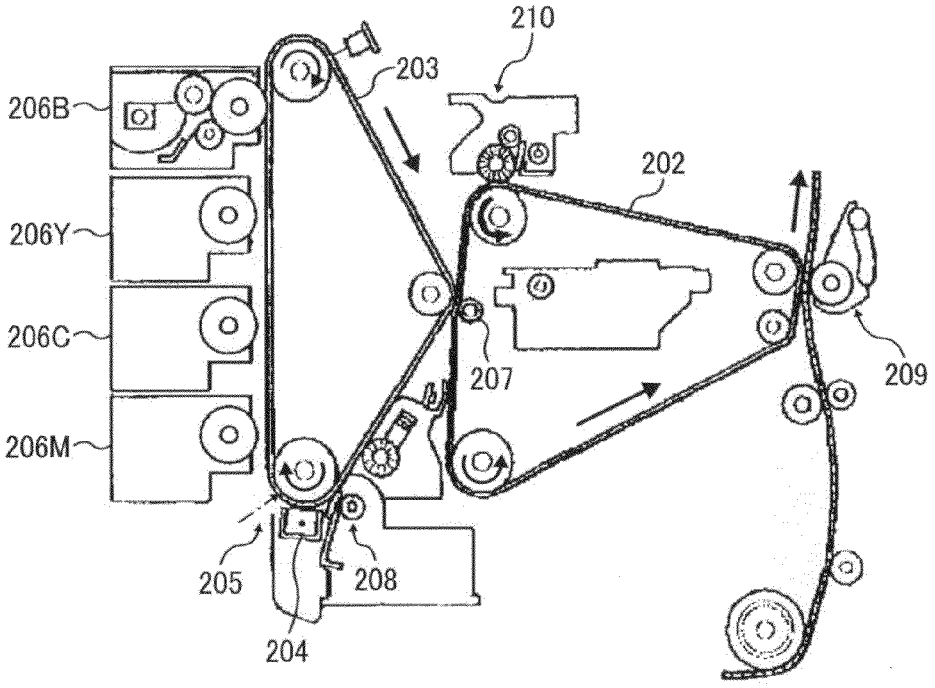
FIG. 17 is a schematic diagram illustrating an example of a single-drum type image forming apparatus according to an illustrative embodiment of the present disclosure.

Furthermore, the image forming apparatus to which the first and the second illustrative embodiments are applied includes, but is not limited to a so-called tandem-type image forming apparatus and a single-drum type image forming apparatus such as shown in FIG. 17 in which toner images are formed on a single photosensitive member and are transferred onto a transfer medium such that they are superimposed one atop the other, forming a color image.

As illustrated in FIG. 17, the image forming apparatus includes a belt-type photosensitive member 203 serving as an image bearing member. Four development devices 206M, 206C, 206Y, and 206B are disposed around the photosensitive member 203 to develop latent images using respective colors of toner. A charging device 204, a writing unit 205, a primary transfer roller 207, and a cleaning device 208 are common to all colors. In this configuration, when forming an image in the full-color mode, first, a magenta toner image is formed on the photosensitive member 203 and is transferred onto an intermediate transfer belt 202 at a primary transfer portion. Subsequently, when the primarily transferred magenta toner image arrives again at the primary transfer portion, a cyan toner image formed on the photosensitive member 203 is primarily transferred over the magenta toner image on the intermediate transfer belt 202. This process is repeated for the toner images of the colors yellow and black, thereby forming a composite toner image on the intermediate transfer belt 202 similar to the tandem-type transfer method. The composite toner image is transferred onto a recording medium by a secondary transfer device 209 at the secondary transfer portion, thereby forming a color image on the recording medium.

The above-described image forming apparatus is an example of the image forming apparatus of the present disclosure. The present disclosure includes the following aspects.

[Aspect A]

According to an aspect A, an image forming apparatus includes an intermediate transfer member (i.e., intermediate transfer member 41) to move in a first direction; a plurality of image bearing members (i.e., photosensitive drums 3Y, 3C, 3M, 3K) to bear toner images thereon, the plurality of image bearing members disposed along the first direction; a plurality of toner image forming devices (i.e., development devices 7Y, 7C, 7M, and 7K) to form the toner images on the plurality of image bearing members using different developing agents; a primary transfer device (i.e., primary transfer rollers 45Y, 45C, 45M, and 45K) to apply a primary transfer bias to primarily transfer each of the toner images formed on the plurality of image bearing members onto a surface of the intermediate transfer member to form a composite toner image; a secondary transfer device (i.e., secondary transfer auxiliary roller 46) to apply a secondary transfer bias to secondarily transfer the composite toner image formed on the intermediate transfer member to a recording medium; a controller (i.e., controller 200) to selectively control image forming operation between a first mode and a second mode such that in the first mode the composite toner image is formed using at least two of the plurality of image bearing members including a first image bearing member (i.e., photosensitive drum 3K) and a second image bearing member and after the composite toner image is formed on the intermediate transfer member the secondary transfer bias is applied to secondarily transfer the composite toner image from the intermediate transfer member to the recording medium, and in the second mode the toner image is formed on the first image bearing member used in the first mode which is disposed downstream from the second image bearing member in the first direction and after the toner image is primarily transferred from the first image bearing member onto the intermediate transfer member the secondary transfer bias less than that in the first mode is applied to transfer the toner image from the intermediate transfer member to the recording medium; a first developing agent condition detector (i.e., developing agent condition detector 200K) to detect a degree of deterioration of a developing agent used to form the toner image on the first image bearing member; and a primary transfer bias adjuster (i.e., primary transfer bias adjuster 200*a*) to adjust, in the second mode, the primary transfer bias by a correction amount in accordance with the degree of deterioration of the developing agent detected by the first developing agent condition detector so as to reduce a primary transfer current of the primary transfer bias upon transferring the toner image from the first image bearing member onto the intermediate transfer member, and to adjust, in the first mode, the primary transfer bias by a correction amount less than the correction amount in the second mode or not to adjust the primary transfer bias in accordance with the degree of deterioration of the developing agent detected by the first developing agent condition detector upon primarily transferring the toner image from the first image bearing member onto the intermediate transfer member.

With this configuration, degradation of image quality is prevented in the first mode (full-color mode) using the plurality of image bearing members, while preventing degradation of the primary transfer rate attributed to the deterioration of the developing agent in the second mode (black single color mode) using one image bearing member.

[Aspect B]

According to the aspect A, the first image bearing member is disposed at an extreme downstream end in the first direction. The toner image primarily transferred from the image bearing member disposed at the extreme downstream end onto the intermediate transfer member is conveyed to the secondary transfer portion without getting charged up by other image bearing members, and the charge amount of the toner is at the lowest at the secondary transfer. Thus, the present disclosure is effective.

[Aspect C]

The image forming apparatus of the aspect B further includes a second developing agent condition detector (i.e., developing agent condition detectors 200Y, 200C, and 200M) to detect deterioration of the developing agent in the toner image formed on the image bearing member used in the first mode other than the first image bearing member. The primary transfer bias adjuster adjusts at least in the first mode the primary transfer bias for the image bearing member used in the first mode other than the first image bearing member by the correction amount corresponding to the degree of deterioration of the developing agent detected by the second developing agent condition detector, and the correction amount is greater than that for the first image bearing member.

Because the toner image primarily transferred from the image bearing member other than the first image bearing member is charged up at least by the first image bearing member before being conveyed to the secondary transfer portion, the decrease in the charge amount of toner of the toner image is compensated by the charge-up with the primary transfer current by the first image bearing member even when the primary transfer current is reduced to improve the primary transfer rate. Thus, the secondary transfer rate is not degraded at the secondary transfer portion. By contrast, the toner image primarily transferred from the image bearing member disposed at the extreme downstream end onto the intermediate transfer member is conveyed to the secondary transfer portion without getting charged up by other image bearing member, and in order to reduce the primary transfer current to enhance the primary transfer rate the charge amount of toner drops, hence affecting significantly the secondary transfer rate. Therefore, in terms of the secondary transfer rate, the amount of adjustment of the primary transfer current for the first image bearing member should not be large. According to the present aspect, the amount of adjustment of the primary transfer current for the first image bearing member is greater than that for other image bearing members, thereby providing well balanced image quality.

[Aspect D]

According to any one of aspects A through C, the image forming apparatus includes a secondary transfer bias adjuster to adjust the secondary transfer bias by an amount in accordance with the correction amount of the primary transfer bias by the primary transfer bias adjuster. This configuration provides good imaging quality over time from the initial state.

[Aspect E]

According to the aspect D, the amount of correction of the secondary transfer bias employed by the secondary transfer adjuster is greater in the second mode than in the first mode. This configuration provides good imaging quality in any of the modes.

[Aspect F]

According to any one of aspects A through D, the image forming apparatus includes a secondary transfer bias adjuster to adjust the secondary transfer bias by an amount in accordance with the degree of deterioration of the developing agent detected by the developing agent condition detector. This configuration provides good imaging quality over time from the initial state.

[Aspect G]

According to any one of aspects A through F, the image forming apparatus includes a secondary transfer bias adjuster to adjust the secondary transfer bias in accordance with an area of the toner image transferred from the second image bearing member disposed upstream from the first image bearing member in the first direction onto the intermediate transfer member. This configuration provides good imaging quality regardless of the image area.

[Aspect H]

According to the aspect G, the secondary transfer bias adjuster adjusts the secondary transfer bias in accordance with the area of the toner image and the degree of deterioration of the developing agent. This configuration provides good imaging quality over time from the initial state.

[Aspect I]

According to the aspect H, the secondary transfer bias adjuster adjusts the secondary transfer bias such that in a case in which the area of the toner image is less than a predetermined area, a secondary transfer current is reduced with an increase in the degree of deterioration of the developing agent.

[Aspect J]

According to any one of aspects A through I, the first image bearing member bears a toner image formed with a black toner. This configuration enhances the image quality using the black toner.

[Aspect K]

According to an aspect K, an image forming apparatus includes an image bearing member (i.e., photosensitive drum 203) to rotate; an intermediate transfer member (i.e., intermediate transfer belt 202) to move in a first direction; a plurality of toner image forming devices (i.e., development devices 206M, 206C, 206Y, and 206B) to form sequentially and overlappingly a plurality of toner images using different developing agents on a surface of the image bearing member to form a composite toner image; a primary transfer device (i.e., primary transfer roller 207) to apply a primary transfer bias to primarily transfer the composite toner image formed on the image bearing member onto a surface of the intermediate transfer member; a secondary transfer device (i.e. secondary transfer device 209) to apply a secondary transfer bias to secondarily transfer the composite toner image having been primarily transferred on the intermediate transfer member onto a recording medium; a controller (i.e., controller 200) to selectively control image forming operation between a first mode (i.e., full-color mode) and a second mode (i.e., black single color mode) such that in the first mode the composite toner image is formed using at least two of the plurality of toner image forming devices including a first toner image forming device and a second toner image forming device and after the composite toner image is primarily transferred onto the intermediate transfer member the secondary transfer bias is applied to secondarily transfer the composite toner image from the intermediate transfer member onto the recording medium, and in the second mode the first toner image forming device (i.e., development device 206B) used in the first mode forms the toner image (black toner image) which is transferred after the toner image formed by the toner image forming device other than the first toner image forming device is transferred and after the toner image formed by the first toner image forming device is primarily transferred onto the intermediate transfer member the secondary transfer bias less than that in the first mode is applied to transfer the toner image from the intermediate transfer member onto the recording medium; a developing agent condition detector (i.e., developing agent condition detectors 200K, 200C, 200M, and 200Y) to detect a degree of deterioration of a developing agent used to form the toner image on the first toner image forming device; and a primary transfer bias adjuster (i.e., primary transfer bias adjuster 200*a*) to adjust the primary transfer bias by a correction amount in accordance with the degree of deterioration of the developing agent detected by the developing agent condition detector so as to reduce a primary transfer current of the primary transfer bias upon transferring the toner image formed by the first toner image forming device in the second mode, and to adjust the primary transfer bias by the correction amount less than the correction amount in the second mode or not to adjust the primary transfer bias in accordance with the degree of deterioration of the developing agent detected by the developing agent condition detector upon primarily transferring the toner image formed by the first toner image forming member in the first mode.

With this configuration, in the tandem-type image forming apparatus, degradation of image quality is prevented in the first mode (full-color mode) while improving the decrease in the primary transfer rate attributed to the deterioration of developing agent in the second mode (black single color mode) using one toner image.

[Aspect L]

According to an aspect L, an image forming apparatus includes a plurality of image bearing members (i.e., photosensitive drums 3Y, 3C, 3M, 3K) to rotate in a first direction;

a plurality of toner image forming devices (i.e., development devices 7M, 7C, 7Y, and 7K) to form a toner image on a surface of each of the plurality of image bearing members with developing agents including toners having different volume resistivities; a plurality of transfer devices (i.e., primary transfer rollers 45M, 45C, 45Y, and 45K) to apply a transfer bias to transfer the toner images formed on the plurality of image bearing members onto a transfer medium to form a composite toner image; a developing agent condition detector (i.e., developing agent condition detectors 200K, 200C, 200M, and 200Y) to detect a degree of deterioration of the developing agents; and a transfer current adjuster (i.e., primary transfer bias adjuster 200*a*) to adjust a transfer current of the transfer bias by a correction amount in accordance with the degree of deterioration of the developing agent detected by the developing agent condition detector upon transferring the toner images formed on at least two image bearing members, the toner images being formed with the developing agents including the toners having different volume resistivities. The correction amount is different between the at least two image bearing members. That is, the correction amount for the photosensitive drum 3B using the black toner is different from that for the photosensitive drums 3Y, 3C, and 3M.

With this configuration, appropriate adjustment of the transfer current is performed in accordance with the volume resistivity of toners when forming toner images using different developing agents having toners of different volume resistivities on at least image bearing members.

[Aspect M]]

According to the aspect L, the development agent condition detector detects the degree of deterioration of the developing agent based on an amount of toner (amount of toner consumption) used by the plurality of the toner image forming devices in a predetermined time period.

The less is the amount of toner consumed by the toner image forming device within a predetermined time period, the faster that the toner deteriorates. The degree of deterioration of the developing agent can be detected reliably with this configuration.

[Aspect N]

According to aspects L or M, a plurality of toner patterns having a same length in the first direction and different lengths in a width direction perpendicular to the first direction of the image bearing members are formed in a non-image forming area of the at least two image bearing members for adjustment of image quality, and the development agent condition detector detects the degree of deterioration of the developing agent by obtaining a difference ΔID in image densities of the plurality of toner patterns based on a detection result of the image densities of the plurality of toner patterns.

With this configuration, the degree of deterioration of the developing agent can be detected using the patterns so that a designated device for detection of the degree of deterioration of the developing agent is not necessary.

[Aspect O]

According to any one of aspects L through N, the image forming apparatus includes an intermediate transfer member (i.e., intermediate transfer belt 2) to move in a second direction as the transfer medium; a secondary transfer device (i.e., secondary transfer device 9) to apply a secondary transfer bias to secondarily transfer the composite toner image from the intermediate transfer member onto a recording medium; and a controller (i.e., controller 200) to selectively control image forming operation between a first mode (full-color mode) and a second mode (i.e., black single color mode) such that in the first mode the composite toner image is formed using the at least two image bearing members including a first image bearing member and a second image bearing member and after the composite toner image is primarily transferred onto the intermediate transfer member the secondary transfer bias is applied to secondarily transfer the composite toner image from the intermediate transfer member to the recording medium, and in the second mode the toner image is formed on the first image bearing member (i.e., photosensitive drum 3K) used in the first mode which is disposed downstream from the second image bearing member in the second direction of the intermediate transfer member and after the toner image is primarily transferred from the first image bearing member onto the intermediate transfer member the secondary transfer bias less than that in the first mode is applied to transfer the toner image from the intermediate transfer member onto the recording medium. In the second mode the transfer current adjuster reduces a primary transfer current of a primary transfer bias with an increase in the degree of deterioration of the developing agent upon primarily transferring the toner image from the first image bearing member onto the intermediate transfer member, while increasing in the first mode the primary transfer current of the primary transfer bias with an increase in the degree of deterioration of the developing agent upon primarily transferring the toner image from the first image bearing member onto the intermediate transfer member.

With this configuration, in the second mode in which the secondary transfer rate is less affected by the adjustment (reduction) of the primary transfer current, the primary transfer current is reduced with an increase in the degree of deterioration of the developing agent to enhance the primary transfer rate, thereby suppressing degradation of image quality. In the first mode in which the secondary transfer rate is significantly affected by the adjustment (reduction) of the primary transfer current, the primary transfer current is increased with an increase in the degree of deterioration of the developing agent to enhance the secondary transfer rate, thereby suppressing degradation of image quality.

[Aspect P]

According to any one of aspects L through N, the image forming apparatus includes an intermediate transfer member to move in a second direction as the transfer medium; a secondary transfer device to apply a secondary transfer bias to secondarily transfer the composite toner image from the intermediate transfer member onto a recording medium; and a controller to control image forming operation in a control mode such as a full-color mode in which the toner images are formed on at least three image bearing members including at least the first image bearing member and the second image bearing member and are primarily transferred onto the intermediate transfer member such that they are superimposed one atop the other to form the composite toner image which is transferred onto the recording medium. In the control mode, the controller controls the image forming operation such that with an increase in the degree of deterioration of the developing agent having a first toner (black toner) used in the toner image formed on one of the at least three image bearing members disposed at a downstream side in the second direction of the intermediate transfer member to express a first color such as the color black in an image, a ratio of use of other toners (the colors of yellow, magenta, and cyan) used in the toner images formed on at least two other image bearing members upstream from the image bearing member used for the first color is increased to express the first color without using the first toner.

With this configuration, as described in the variation 3, even when the degree of deterioration of the developing agent, the image density of the respective color is prevented from dropping.

[Aspect Q]

According to any one of aspects L through O, the image forming apparatus includes an intermediate transfer member to move in a second direction as the transfer target; a secondary transfer device to apply a secondary transfer bias to secondarily transfer the composite toner image on the intermediate transfer member onto a recording medium; and a secondary transfer adjuster to adjust a secondary current of the secondary transfer bias by an amount in accordance with the correction amount of the transfer current by the transfer current adjuster.

With this configuration, the degradation of the secondary transfer rate attributed to the adjustment of the primary transfer current is suppressed, thereby enhancing image quality.

[Aspect R]

According to any one of aspects L through Q, the image forming apparatus includes an environment information obtaining device (i.e., environment information obtaining device 90) to obtain environment information including at least temperature and humidity. The correction amount employed by the transfer current adjuster is changed in accordance with the environment information.

This configuration allows adjustment of the transfer current in accordance with changes in the environment.

[Aspect S]

According to any one of aspects L through Q, the image forming apparatus includes an electrical resistance detector (i.e., electrical resistance detectors 80Y, 80M, 80C, 80K) to detect an electrical resistance of a path through which the transfer current flows upon transferring the toner image from the at least two image bearing members onto the transfer medium. The correction amount employed by the transfer current adjuster is changed in accordance with the electrical resistance.

With this configuration, as described in the variation 6, the transfer current is reliably adjusted in accordance with changes in the electrical resistance of the transfer devices (the electrical resistance material on the primary transfer current path).

[Aspect T]

According to any one of aspects L through T, the image forming apparatus includes an image bearing member (i.e., image bearing member 203) to rotate in a first direction; a plurality of toner image forming devices (development devices 206M, 206C, 206Y, 206B) to form toner images on a surface of the image bearing member using different developing agents including toners having different volume resistivities; a transfer device (i.e., primary transfer roller 207) to apply a transfer bias to transfer sequentially the toner images formed on the plurality of image bearing members onto a transfer medium to form a composite toner image; a developing agent condition detector (i.e., developing agent condition detectors 200K, 200C, 200M, and 200Y) to detect a degree of deterioration of the developing agents; and a transfer current adjuster (i.e., primary transfer current adjuster 200*a*) to adjust a transfer current of the transfer bias by a correction amount in accordance with the degree of deterioration of the developing agents detected by the developing agent condition detector upon transferring at least two toner images formed with the developing agents including the toners having different volume resistivities. The correction amount is different between the at least two toner images.

With this configuration, in the single-drum type image forming apparatus, the transfer current is reliably adjusted in accordance with different volume resistivities of the toners when forming toner images with different development agents including toners having different volume resistivities on at least two image bearing members.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an intermediate transfer member to move in a first direction;

a plurality of image bearing members to bear toner images thereon, the plurality of image bearing members disposed along the first direction;

a plurality of toner image forming devices to form the toner images on the plurality of image bearing members using different developing agents;

a primary transfer device to apply a primary transfer bias to primarily transfer each of the toner images formed on the plurality of image bearing members onto a surface of the intermediate transfer member to form a composite toner image;

a secondary transfer device to apply a secondary transfer bias to secondarily transfer the composite toner image formed on the intermediate transfer member to a recording medium;

a controller to selectively control image forming operation between a first mode and a second mode such that in the first mode the composite toner image is formed using at least two of the plurality of image bearing members including a first image bearing member and a second image bearing member and after the composite toner image is formed on the intermediate transfer member the secondary transfer bias is applied to secondarily transfer the composite toner image from the intermediate transfer member to the recording medium, and in the second mode the toner image is formed on the first image bearing member used in the first mode which is disposed downstream from the second image bearing member in the first direction and after the toner image is primarily transferred from the first image bearing member onto the intermediate transfer member the secondary transfer bias less than that in the first mode is applied to transfer the toner image from the intermediate transfer member to the recording medium;

a first developing agent condition detector to detect a degree of deterioration of a developing agent used to form the toner image on the first image bearing member; and a primary transfer bias adjuster to adjust, in the second mode, the primary transfer bias by a correction amount in accordance with the degree of deterioration of the developing agent detected by the first developing agent condition detector so as to reduce a primary transfer current of the primary transfer bias upon transferring the toner image from the first image bearing member onto the intermediate transfer member, and to adjust, in the first mode, the primary transfer bias by a correction amount less than the correction amount in the second mode or not to adjust the primary transfer bias in accordance with the degree of deterioration of the developing agent detected by the first developing agent condition detector upon primarily transferring the toner image from the first image bearing member onto the intermediate transfer member.

2. The image forming apparatus according to claim 1, wherein the first image bearing member is disposed at an extreme downstream end in the first direction.

3. The image forming apparatus according to claim 2, further comprising a second developing agent condition detector to detect deterioration of the developing agent in the toner image formed on the image bearing member used in the first mode other than the first image bearing member, wherein the primary transfer bias adjuster adjusts at least in the first mode the primary transfer bias for the image bearing member used in the first mode other than the first image bearing member by the correction amount corresponding to the degree of deterioration of the developing agent detected by the second developing agent condition detector, and the correction amount is greater than that for the first image bearing member.

4. The image forming apparatus according to claim 1, further comprising a secondary transfer bias adjuster to adjust the secondary transfer bias by an amount in accordance with the correction amount of the primary transfer bias by the primary transfer bias adjuster.

5. The image forming apparatus according to claim 4, wherein the amount of correction of the secondary transfer bias employed by the secondary transfer adjuster is greater in the second mode than in the first mode.

6. The image forming apparatus according to claim 1, further comprising a secondary transfer bias adjuster to adjust the secondary transfer bias by an amount in accordance with the degree of deterioration of the developing agent detected by the developing agent condition detector.

7. The image forming apparatus according to claim 1, further comprising a secondary transfer bias adjuster to adjust the secondary transfer bias in accordance with an area of the toner image transferred from the second image bearing member disposed upstream from the first image bearing member in the first direction onto the intermediate transfer member.

8. The image forming apparatus according to claim 7, wherein the secondary transfer bias adjuster adjusts the secondary transfer bias in accordance with the area of the toner image and the degree of deterioration of the developing agent.

9. The image forming apparatus according to claim 8, wherein the secondary transfer bias adjuster adjusts the secondary transfer bias such that in a case in which the area of the toner image is less than a predetermined area, a secondary transfer current is reduced with an increase in the degree of deterioration of the developing agent.

10. The image forming apparatus according to claim 1, wherein the first image bearing member bears a toner image formed with a black toner.

11. An image forming apparatus, comprising:

an image bearing member to rotate;

an intermediate transfer member to move in a first direction;

a plurality of toner image forming devices to form sequentially and overlappingly a plurality of toner images using different developing agents on a surface of the image bearing member to form a composite toner image;

a primary transfer device to apply a primary transfer bias to primarily transfer the composite toner image formed on the image bearing member onto a surface of the intermediate transfer member;

a secondary transfer device to apply a secondary transfer bias to secondarily transfer the composite toner image having been primarily transferred on the intermediate transfer member onto a recording medium;

a controller to selectively control image forming operation between a first mode and a second mode such that in the first mode the composite toner image is formed using at least two of the plurality of toner image forming devices including a first toner image forming device and a second toner image forming device and after the composite toner image is primarily transferred onto the intermediate transfer member the secondary transfer bias is applied to secondarily transfer the composite toner image from the intermediate transfer member onto the recording medium, and in the second mode the first toner image forming device used in the first mode forms the toner image which is transferred after the toner image formed by the toner image forming device other than the first toner image forming device is transferred and after the toner image formed by the first toner image forming device is primarily transferred onto the intermediate transfer member the secondary transfer bias less than that in the first mode is applied to transfer the toner image from the intermediate transfer member onto the recording medium;

a developing agent condition detector to detect a degree of deterioration of a developing agent used to form the toner image on the first toner image forming device; and a primary transfer bias adjuster to adjust the primary transfer bias by a correction amount in accordance with the degree of deterioration of the developing agent detected by the developing agent condition detector so as to reduce a primary transfer current of the primary transfer bias upon transferring the toner image formed by the first toner image forming device in the second mode, and to adjust the primary transfer bias by the correction amount less than the correction amount in the second mode or not to adjust the primary transfer bias in accordance with the degree of deterioration of the developing agent detected by the developing agent condition detector upon primarily transferring the toner image formed by the first toner image forming member in the first mode.

12. An image forming apparatus, comprising:

a plurality of image bearing members to rotate in a first direction;

a plurality of toner image forming devices to form a toner image on a surface of each of the plurality of image bearing members with developing agents including toners having different volume resistivities;

a plurality of transfer devices to apply a transfer bias to transfer the toner images formed on the plurality of image bearing members onto a transfer medium to form a composite toner image;

a developing agent condition detector to detect a degree of deterioration of the developing agents; and a transfer current adjuster to adjust a transfer current of the transfer bias by a correction amount in accordance with the degree of deterioration of the developing agent detected by the developing agent condition detector upon transferring the toner images formed on at least two image bearing members, the toner images being formed with the developing agents including the toners having different volume resistivities, wherein the correction amount is different between the at least two image bearing members.

13. The image forming apparatus according to claim 12, wherein the development agent condition detector detects the degree of deterioration of the developing agent based on an amount of toner used by the plurality of the toner image forming devices in a predetermined time period.

14. The image forming apparatus according to claim 12, wherein a plurality of toner patterns having a same length in the first direction and different lengths in a width direction perpendicular to the first direction of the image bearing members are formed in a non-image forming area of the at least two image bearing members for adjustment of image quality, and the development agent condition detector detects the degree of deterioration of the developing agent by obtaining a difference in image densities of the plurality of toner patterns based on a detection result of the image densities of the plurality of toner patterns.

15. The image forming apparatus according to claim 12, further comprising:

an intermediate transfer member to move in a second direction as the transfer medium;

a secondary transfer device to apply a secondary transfer bias to secondarily transfer the composite toner image from the intermediate transfer member onto a recording medium; and a controller to selectively control image forming operation between a first mode and a second mode such that in the first mode the composite toner image is formed using the at least two image bearing members including a first image bearing member and a second image bearing member and after the composite toner image is primarily transferred onto the intermediate transfer member the secondary transfer bias is applied to secondarily transfer the composite toner image from the intermediate transfer member to the recording medium, and in the second mode the toner image is formed on the first image bearing member used in the first mode which is disposed downstream from the second image bearing member in the second direction of the intermediate transfer member and after the toner image is primarily transferred from the first image bearing member onto the intermediate transfer member the secondary transfer bias less than that in the first mode is applied to transfer the toner image from the intermediate transfer member onto the recording medium, wherein in the second mode the transfer current adjuster reduces a primary transfer current of a primary transfer bias with an increase in the degree of deterioration of the developing agent upon primarily transferring the toner image from the first image bearing member onto the intermediate transfer member, while increasing in the first mode the primary transfer current of the primary transfer bias with an increase in the degree of deterioration of the developing agent upon primarily transferring the toner image from the first image bearing member onto the intermediate transfer member.

16. The image forming apparatus according to claim 12, further comprising:

an intermediate transfer member to move in a second direction as the transfer medium;

a secondary transfer device to apply a secondary transfer bias to secondarily transfer the composite toner image from the intermediate transfer member onto a recording medium; and a controller to control image forming operation in a control mode in which the toner images are formed on at least three image bearing members including at least the first image bearing member and the second image bearing member and are primarily transferred onto the intermediate transfer member such that they are superimposed one atop the other to form the composite toner image which is transferred onto the recording medium, wherein in the control mode the controller controls the image forming operation such that with an increase in the degree of deterioration of the developing agent having a first toner used in the toner image formed on one of the at least three image bearing members disposed at a downstream side in the second direction of the intermediate transfer member to express a first color in an image, a ratio of use of other toners used in the toner images formed on at least two other image bearing members upstream from the image bearing member used for the first color is increased to express the first color without using the first toner.

17. The image forming apparatus according to claim 12, further comprising:

an intermediate transfer member to move in a second direction as the transfer target;

a secondary transfer device to apply a secondary transfer bias to secondarily transfer the composite toner image on the intermediate transfer member onto a recording medium; and a secondary transfer adjuster to adjust a secondary current of the secondary transfer bias by an amount in accordance with the correction amount of the transfer current by the transfer current adjuster.

18. The image forming apparatus according to claim 12, further comprising an environment information obtaining device to obtain environment information including at least temperature and humidity, wherein the correction amount employed by the transfer current adjuster is changed in accordance with the environment information.

19. The image forming apparatus according to claim 12, further comprising an electrical resistance detector to detect an electrical resistance of a path through which the transfer current flows upon transferring the toner image from the at least two image bearing members onto the transfer medium, wherein the correction amount employed by the transfer current adjuster is changed in accordance with the electrical resistance.

20. An image forming apparatus, comprising:

an image bearing members to rotate in a first direction;

a plurality of toner image forming devices to form a plurality of toner images on a surface of the image bearing member using different developing agents including toners having different volume resistivities;

a transfer device to apply a transfer bias to transfer sequentially the toner images formed on the image bearing member onto a transfer medium to form a composite toner image;

a developing agent condition detector to detect a degree of deterioration of the developing agents; and a transfer current adjuster to adjust a transfer current of the transfer bias by a correction amount in accordance with the degree of deterioration of the developing agents detected by the developing agent condition detector upon transferring at least two toner images formed with the developing agents including the toners having different volume resistivities, wherein the correction amount is different between the at least two toner images.

* * * * *